US005141657A

United States Patent [19]

Fetterman, Jr. et al.

[11] Patent Number: 5,141,657

[45] Date of Patent: * Aug. 25, 1992

[54] LUBRICANT COMPOSITIONS FOR INTERNAL COMBUSTION ENGINES

[75] Inventors: Glen P. Fetterman, Jr., Morris Plains; Alan A. Schetelich, Scotch Plains, both of N.J.

[73] Assignee: Exxon Chemical Patents Inc., Linden, N.J.

[ * ] Notice: The portion of the term of this patent subsequent to Apr. 7, 2009 has been disclaimed.

[21] Appl. No.: 359,961

[22] Filed: Jun. 1, 1989

Related U.S. Application Data

[63] Continuation of Ser. No. 104,175, Oct. 2, 1987, abandoned.

[51] Int. Cl.[5] ..... C10M 105/04; C10M 111/02

[52] U.S. Cl. ..... 252/32.7 E; 252/32; 252/32.7 R; 252/48.2

[58] Field of Search ..... 252/32, 32.7 R, 32.7 E, 252/48.2

[56] References Cited

U.S. PATENT DOCUMENTS

| | | | |
|---|---|---|---|
| 4,1563,562 | 5/1979 | Jarezelski . | |
| 2,389,527 | 11/1945 | McCleary | 252/46.7 |
| 2,713,557 | 7/1955 | Lowe | 252/32.7 E |
| 2,766,207 | 10/1956 | McDermott | 252/32.7 E |
| 3,018,247 | 1/1962 | Anderson et al. . | |
| 3,018,250 | 1/1962 | Anderson et al. . | |
| 3,018,291 | 1/1962 | Anderson et al. . | |
| 3,215,632 | 11/1965 | Hughes et al. | 252/51.5 |
| 3,239,462 | 3/1966 | Bergstrom et al. | 252/33.6 |
| 3,272,746 | 9/1966 | Le Suer et al. | 252/47.5 |
| 3,285,854 | 11/1966 | Malone | 252/46.7 |
| 3,320,163 | 5/1967 | Abbott et al. | 252/48.2 |
| 3,519,564 | 7/1970 | Vogel | 252/47.5 |
| 3,533,943 | 10/1970 | Papayannopoulos | 252/32.7 |
| 3,714,042 | 1/1973 | Greenough | 252/33.2 |
| 3,853,774 | 12/1974 | Crocker | 252/33.4 |
| 3,865,739 | 2/1975 | Waldbillig | 252/47 |
| 3,869,395 | 3/1975 | Waldbillig | 252/47 |
| 3,879,306 | 4/1975 | Kablaoui et al. | 252/51.5 |
| 3,904,537 | 9/1975 | Ripple | 252/47.5 |
| 4,048,056 | 9/1977 | Romovacek | 208/41 |
| 4,089,790 | 5/1978 | Adams | 252/18 |
| 4,089,791 | 5/1978 | Haugen et al. . | |
| 4,089,794 | 5/1978 | Engel et al. | 252/51.5 A |
| 4,104,179 | 8/1978 | Colclough | 252/32.7 E |
| 4,113,639 | 9/1978 | Lonstrup et al. | 252/51.5 A |
| 4,115,287 | 9/1978 | Colclough et al. | 252/48.2 |
| 4,123,369 | 10/1978 | Miller . | |
| 4,136,043 | 1/1979 | Davis | 252/47.5 |
| 4,140,643 | 2/1979 | Davis | 252/47.5 |
| 4,147,640 | 4/1979 | Jayne et al. . | |
| 4,157,972 | 6/1979 | Hotten . | |
| 4,163,729 | 8/1979 | Adams | 252/18 |
| 4,164,473 | 8/1979 | Coupland . | |
| 4,165,292 | 8/1979 | Davis et al. . | |
| 4,173,540 | 11/1979 | Lonstrup et al. | 252/49.6 |

(List continued on next page.)

FOREIGN PATENT DOCUMENTS

| | | |
|---|---|---|
| 1048994 | 2/1979 | Canada . |
| 0024146 | 2/1981 | European Pat. Off. . |
| 0092946 | 4/1983 | European Pat. Off. . |
| 0167295 | 1/1986 | European Pat. Off. . |
| 0209730 | 6/1986 | European Pat. Off. . |
| 0310366 | 9/1988 | European Pat. Off. . |
| 0311319 | 4/1989 | European Pat. Off. . |

(List continued on next page.)

*Primary Examiner*—Brian E. Hearn
*Assistant Examiner*—M. Nuzzolillo
*Attorney, Agent, or Firm*—J. B. Murray, Jr.

[57] ABSTRACT

In accordance with the present invention, there are provided low sulfated ash lubricating oil compositions which copmrise an oil of lubricating viscosity as the major component and as the minor component (A) at least about 3 wt % of at least one ashless nitrogen- or ester-containing dispersant, (B) at least about 2 wt % of at least one sulfurized alkyl phenol, and (C) at least one metal dihydrocarbyl dithiophosphate wherein the hydrocarbyl groups contain an average of at least 6 carbon atoms, and wherein the lubricating oil is characterized by a total sulfated ash (SASH) level of from 0.01 to about 0.6 wt % and by a SASH:dispersant wt:wt ratio of from about 0.01 to about 0.2:1.

6 Claims, 1 Drawing Sheet

U.S. PATENT DOCUMENTS

| | | | |
|---|---|---|---|
| 4,178,259 | 12/1979 | King | 252/42.7 |
| 4,192,757 | 3/1980 | Davis et al. . | |
| 4,201,683 | 5/1980 | Brewster . | |
| 4,219,430 | 8/1980 | Vaughan | 252/42.7 |
| 4,246,126 | 1/1981 | Arakelian et al. | 252/47.5 |
| 4,248,720 | 2/1981 | Coupland . | |
| 4,282,106 | 8/1981 | Schaap | 252/32.7 E |
| 4,330,420 | 5/1982 | White et al. . | |
| 4,372,862 | 2/1983 | Miller | 252/33 |
| 4,375,418 | 3/1983 | Zoleski et al. | 252/33.4 |
| 4,382,005 | 5/1983 | Miller . | |
| 4,427,560 | 1/1984 | Holstedt et al. | 252/42.7 |
| 4,502,970 | 3/1985 | Schetelich et al. . | |
| 4,517,104 | 5/1985 | Bloch et al. | 252/51.5 A |
| 4,533,480 | 8/1985 | Holstedt et al. | 252/46.4 |
| 4,557,843 | 12/1985 | Holstedt et al. | 252/46.4 |
| 4,595,514 | 1/1986 | Holstedt et al. | 252/46.4 |
| 4,612,129 | 9/1986 | Dibiase et al. | 252/33.6 |
| 4,623,474 | 11/1986 | Holstedt et al. | 252/47.5 |
| 4,627,930 | 12/1986 | Holstedt et al. | 252/49.6 |
| 4,629,579 | 12/1986 | Jessup et al. | 252/33.6 |
| 4,629,580 | 12/1986 | Holstedt et al. | 252/49.6 |
| 4,639,324 | 1/1987 | Lam . | |
| 4,657,686 | 4/1987 | Holstedt et al. | 252/47.5 |
| 4,683,069 | 7/1987 | Brewster et al. | 252/32.7 E |

FOREIGN PATENT DOCUMENTS

| | | |
|---|---|---|
| 2174021 | 10/1973 | France . |
| 47-234908 | 9/1972 | Japan . |
| 987142 | 3/1965 | United Kingdom . |
| 1102032 | 2/1968 | United Kingdom . |
| 1153269 | 3/1968 | United Kingdom . |
| 1404714 | 1/1973 | United Kingdom . |
| 2062672 | 5/1981 | United Kingdom . |
| 8604602 | 8/1986 | World Int. Prop. O. . |
| 8606092 | 10/1986 | World Int. Prop. O. . |

OTHER PUBLICATIONS

J. A. McGeehan, Society of Automotive Engineers, Inc., "Effect of Piston Deposits, Fuel Sulfur, and Lubricant Viscosity on Diesel Engine Oil Consumption and Cylinder Bore Polishing", 1984, pp. 4.848–4.869.

Schetelich, et al., The Control of Piston Crownland Deposits in Diesel Engines Through Oil Formulation, Oct. 6–9, 1986.

McGeehan, et al., Some Effects of Zinc Dithiophosphates and Detergents on Controlling Engine Wear, 1986, pp. 879–892.

Hercamp, Premature Loss of Oil Consumption Control in a Heavy Duty Diesel Engine (SAE Technical Paper Series), Oct. 31–Nov. 3, 1983, pp. 1–20.

Schetelich, The Effects of Lubricating Oil Parameters on PC-1 Type Heavy Duty Performance, (SAE Technical Paper Series), Oct. 31–Nov. 3, 1983, pp. 1–10.

o = EXAMPLE 3 OIL FORMULATION
• = REFERENCE OIL CTO 1-3

LUBRICANT COMPOSITIONS FOR INTERNAL COMBUSTION ENGINES

This is a continuation of application Ser. No. 104,175, filed Oct. 2, 1987, abd.

FIELD OF THE INVENTION

This invention relates to lubricating oil compositions which exhibit marked reduction in engine carbon deposits More particularly, this invention is directed to low total sulfated ash lubricating oil compositions which are adapted for use in diesel engines and which contain ashless dispersants, sulfurized alkyl phenols and metal dihydrocarbyl dithiophosphates and which are required to contain unique low levels of sulfated ash generating additives.

BACKGROUND OF THE INVENTION

It is an objective of the industry to provide lubricating oil compositions which exhibit improvements in minimized engine deposits and low rates of lubricating oil consumption, particularly in diesel engine vehicles.

Among the conventionally used lubricating oil additives, zinc dihydrocarbyl dithiophosphates perform multiple functions in the motor oil, namely, oxidation inhibition, bearing corrosion inhibition, and extreme pressure/antiwear protection for the valve train.

Early patents illustrated compositions using polyisobutenylsuccinimide dispersants in combination with zinc dialkyldithiophosphates which were employed in lubricating oil compositions with other conventional additives such as detergents, viscosity index improvers, rust inhibitors and the like. Typical of these early disclosures are U.S. Pat. Nos. 3,018,247, 3,018,250 and 3,018,291.

Since phosphorus is a catalyst poison for catalytic converters, and since the zinc itself offers a source for sulfated ash, the art has sought to reduce or eliminate such zinc-phosphorus-containing motor oil components. Exemplary of prior art references directed to the reduction in phosphorus-containing lubricant additives are U.S. Pat. Nos. 4,147,640; 4,330,420; and 4,639,324.

U.S. Pat. No. 4,147,640 relates to lubricating oils having improved antioxidant and antiwear properties which are obtained by reacting an olefinic hydrocarbon having from 6 to 8 carbon atoms and about 1 to 3 olefinic double bonds concurrently with sulfur and hydrogen sulfide and thereafter reacting the resulting reaction intermediate with additional olefin hydrocarbon. These additives are disclosed to be generally used in conjunction with other conventional oil additives such as overbased metal detergents, polyisobutenylsuccinimide dispersants, and phenolic antioxidants. While it is disclosed that the amount of the zinc additive can be greatly reduced, giving a "low ash" or "no ash" lubricant formulation, it is apparent the patentee was referring to Zn-derived ash, and not total SASH levels.

U.S. Pat. No. 4,330,420 relates to low ash, low phosphorus motor oils having improved oxidation stability as a result the inclusion of synergistic amounts of dialkyldiphenylamine antioxidant and sulfurized polyolefin. It is disclosed that the synergism between these two additives compensates for the decreased amounts of phosphorus in the form of zinc dithiophosphate. The fully formulated motor oils are said to comprise 2 to 10 wt. % of ashless dispersant, 0.5 to 5 wt. % of recited magnesium or calcium detergent salts (to provide at least 0.1% of magnesium or calcium), from 0.5 to 2.0 wt. % of zinc dialkyldithiophosphate; from 0.2 to 2.0 wt. % of a dialkyldiphenolamine antioxidant; from 0.2 to 4 wt. % of a sulfurized polyolefin antioxidant; from 2 to 10 wt. % of a first, ethylene propylene VI improver; from 2 to 10 wt. % of a second VI improver consisting of methacrylate terpolymer, and the balance baseoil.

U.S. Pat. No. 4,639,324 discloses that metal dithiophosphate salts, while useful as antioxidants, are a source of ash, and discloses an ashless antioxidant comprising a reaction product made by reacting at least one aliphatic olefinically unsaturated hydrocarbon having from 8 to 36 carbons concurrently with sulfur and at least one fatty acid ester to obtain a reaction intermediate which is then reacted with additional sulfur and a dimer of cyclopentadiene or lower $C_1$ to $C_4$ alkyl substituted cyclopentadiene dimers. It is disclosed that these additives in lubricating compositions are generally used in conjunction with other conventional oil additives such as neutral and overbased calcium or magnesium alkaryl sulfonates, dispersants and phenolic antioxidants. It is disclosed that when using the additives of this invention, the amount of the zinc additive can be greatly reduced giving a "low ash" or "no ash" lubricant formulation. Again, it is apparent that the patentee was referring to Zn-derived ash, and not to total SASH.

Metal detergents have been heretofore employed in motor oils to assist in controlling varnish formation and corrosion, and to thereby minimize the adverse impact which varnish and corrosion have upon the efficiency of an internal combustion engine by minimizing the clogging of restricted openings and the reduction in the clearance of moving parts.

U.S. Pat. No. 4,089,791 relates to low ash mineral lubricating oil compositions comprising a mineral oil base in minor amounts of an overbased alkaline earth metal compound, a zinc dihydrocarbyl dithiphosphate (ZDDP) and a substituted trialkanolamine compound, wherein at least 50% of the ZDDP compounds consists of zinc dialkaryl dithiophosphates, in order to provide a formulated motor oil which will pass the MS IIC Rust Test and the L-38 Bearing Weight Loss Test. The patent illustrates three oil formulations, containing overbased calcium detergent, ZDDP, trialkanolamine and unspecified conventional lubricating oil additives to provide viscosity index improvement, antioxidant, dispersant and anti-foaming properties. The illustrated formulations each had about 0.66 wt. % SASH levels, based on the reported Ca and Zn concentrations. No diesel motor oil formulations are illustrated.

U.S. Pat. No. 4,153,562 relates to antioxidants, which are disclosed to be particularly useful for compounded lubricating oils that are intended for heavy duty use in automotive crankcase formulations of relatively low ash content, wherein the antioxidants are prepared by the condensation of phosphorodithioates of alkylphenol sulfides with unsaturated compounds such as styrene. The antioxidants are exemplified at levels of from 0.3 to 1.25 wt. % in lube oil compositions (Example 3) which also contain about 2.65 wt. % (a.i.) borated polyisobutenylsuccinimide dispersant, about 0.06 wt. % Mg as overbased magnesium sulfonate detergent inhibitor, and about 0.10 wt. % Zn as zinc dialkyldithiophosphate antiwear agent (containing mixed $C_4/C_5$ alkyl groups).

U.S. Pat. No. 4,157,972 indicates that the trend to unleaded fuels and ashless lubricating compositions has necessitated the search for non-metallic (ashless) substitutes for metallo-organo detergents, and relates to tetrahydropyrimidyl-substituted compounds which are disclosed to be useful as ashless bases and rust inhibitors. The Examples of the Patent compare the performance of various lubricating oil formulations in a Ford V8 varnish test (Table I) and additional formulations, which are named as either "low-ash" or "ashless", in a Humidity Cabinet Rust Test (Table II). The SASH levels of the "low ash" formulations are not reported and cannot be determined from the information given for the metal detergent- and ZDDP- components.

U.S. Pat. No. 4,165,292 discloses that overbased metal compounds provide effective rust inhibition in automotive crankcase lubricants and that in the absence of overbased additives, as in ashless oils, or when such additives are present in reduced amounts, as in "low ash" oils, rusting becomes a serious problem. Such rust requirements are evaluated by ASTM Sequence IIC engine-tests. The Patent discloses a non-ash forming corrosion or rust inhibitor comprising a combination of an oil-soluble basic organic nitrogen compound (having a recited basicity value) and an alkenyl or alkyl substituted succinic acid having from 12 to 50 carbon atoms. The basic organic nitrogen compound and the carboxylic acid compound are required to be used together to achieve the desired rust-inhibiting properties. It is disclosed that best results are achieved by use of an excess of amine over that required to form the neutral salts of the substituted succinic acid present.

U.S. Pat. No. 4,502,970 relates to improved crankcase lubricating oil compositions containing lubricating oil dispersant, overbased metal detergent, zinc dialkyldithiophosphate antiwear additive and polyisobutenylsuccinic anhydride, in recited amounts. Exemplary lubricating oil formulations are disclosed containing 3 wt. % polyisobutenylsuccinimide dispersant, polyisobutenylsuccinic anhydride, overbased metal sulfonate or overbased sulfurized phenate detergents and zinc dialkyldithiophosphate antiwear agents, in base oil, in amounts of 3.0, 3.0, 2.0, 1.0 and 91.0 wt. %, respectively.

European Patent 24,146 relates to lubricating oil compositions containing copper antioxidants, and exemplifies copper antioxidants in lubricating oil compositions also containing 1.0 wt. % of a 400 TBN magnesium sulphonate (containing 9.2 wt. % magnesium), 0.3 wt. % of a 250 TBN calcium phenate (containing 9.3 wt. % of calcium) and a zinc dialkyldithiophosphate in which the alkyl groups or a mixture of such groups having between 4 and 5 carbon atoms and made by reacting phosphorous $P_2S_5$ with a mixture of about 65% isobutyl alcohol and 35% of amyl alcohol, to give a phosphorous level of 1.0 wt. % in lubricating oil composition.

Published British Patent Application 2,062,672 relates to additive compositions comprising sulfurized alkyl phenol and an oil soluble carboxylic dispersant containing a hydrocarbon-based radical having a number average molecular weight of at least 1300, which is disclosed in combination with ash-producing detergents.

However, it is extremely difficult to translate lube oil developments intended for passenger car and light truck service, whether gasoline or light duty diesel engines, into lubricating oils intended for use in heavy duty diesel service.

R. D. Hercamp, SAE Technical Paper Series, Paper No. 831720 (1983) reports development work on engine test procedures to measure the relative ability of various lubricant formulations to control oil consumption in heavy duty diesel engines. The author indicates that lab analysis of crown land deposits on the diesel engine pistons show an organic binder to be present which contains high molecular weight esters, and the author speculates that oxidation products in the oil may be precursors for the binder found in the deposits. It is indicated that improved antioxidants could be the key to prevent premature oil consumption.

A. A. Schetelich, SAE Technical Paper Series, Paper No. 831722 (1983) reports on the effect of lubricating oil parameters on PC-1 type heavy duty diesel lubricating oil performance. It is noted that over the past 30 years, the trend in heavy duty diesel oil industry has been to decrease the sulfated ash levels from 2.5 wt. % sulfated ash (SASH) in 1960 to the typical North American SASH level of 0.8 to 1 wt. %, and to correspondingly decrease the HD oils total base number (TBN) D2896 values from over 20 to the present typical North American TBN values of from 7 to 10. Such reductions in SASH and TBN levels are attributed by the author to be due to improvement in performance of ashless components, including ashless diesel detergents and ashless dispersants. In diesel engine tests, no significant correlation was seen between the level of either piston deposits or oil consumption and the SASH or TBN levels, for about 1% to 2% SASH levels and about 8 to 17 TBN levels. In contrast, a significant correlation was seen between the level of ashless component treat and the amount of piston deposits (at the 92% confidence level) and oil consumption (at the 98% confidence level). It is noted by the authors that this correlation is drawn with respect to diesel fuels having average sulfur levels of less than about 0.5%. It is indicated that the level of buildup of ash is accelerated in the hotter engine areas. The author concludes that at the 97% confidence level there should be a correlation between oil consumption and piston deposits, especially top land deposits, which are believed to contribute to increased oil consumption due to two phenomena: (1) these deposits decrease the amount of blow-by flowing downwardly past the top land, which results in a decreased gas loading behind the top ring of the piston, which in turn leads to higher oil consumption; and (2) increased bore polishing of the piston cylinder liner by the top land deposits which in turn contributes to higher oil consumption by migration of the oil into the firing chamber of the cylinder along the polished bore paths. Therefore, the Paper concluded that reduced ash in the oil should be sought to reduce top land deposits, and hence oil consumption.

This 1983 Schetelich paper reports formulation of 2 test oils, each containing about 1% SASH and having TBN levels of 10 and 9, respectively, wherein each formulated oil contained overbased metal detergent together with a zinc-source.

J. A. McGeehan, SAE Paper No. 831721, pp. 4.848–4.869 (1984) summarized the results of a series of heavy duty diesel engine tests to investigate the effect of top land deposits, fuel sulfur and lubricant viscosity on diesel engine oil consumption and cylinder bore polishing. These authors also indicated that excessive top land deposits cause high oil consumption and cylinder bore polishing, although they added that cylinder board polishing is also caused in high sulfur fuels by corrosion in oils of low alkalinity value. Therefore, they concluded that oil should provide sufficient alkalinity to minimize the corrosive aspect of bore polishing The authors reported that an experimental 0.01% sulfated ash oil, which was tested in a AVL-Mack TZ675 (turbocharged) 120-hour test in combination with a 0.2% fuel sulfur, provided minimum top land deposits and very low oil consumption, which was said to be due to the "very effective ashless inhibitor". This latter component was not further defined Further, from the data presented by the author in FIG. 4 of this Paper, there do not appear to be oil consumption credits to reducing the ash level below 1%, since the oil consumption in the engine actually rose upon reducing the SASH from 1 to 0.01%. This reinforces the author's view that a low, but significant SASH level is required for sufficient alkalinity to avoid oil consumption as a result of bore polishing derived from corrosive aspects of the oil.

McGeehan concluded that the deposits on the top land correlate with oil consumption but are not directly related to the lubricant sulfated ash, and commented that these deposits can be controlled by the crankcase oil formulation.

SUMMARY OF THE INVENTION

In accordance with the present invention, there are provided low sulfated ash, heavy duty diesel lubricating oil compositions which comprise an oil of lubricating viscosity as the major component and as the minor component (A) at least about 3 wt. % of at least one ashless dispersant, (B) at least 2 wt. % of at least one sulfurized alkyl phenol, and (C) at least one metal dihydrocarbyl dithiophosphate, wherein the lubricating oil is characterized by a total sulfated ash (SASH) level of less than about 0 6 wt % SASH and by a SASH:dispersant wt:wt ratio of from about 0 01 to about 0.2:1.

It has been surprisingly found that the low ash lubricating oils of this invention achieve greatly reduced crownland deposits in heavy duty diesel engines while maintaining the desired additional performance properties for commercially acceptable oils. In particular, this invention has been surprisingly found to provide low ash formulations which pass the modern high severity heavy duty diesel lubricating oil specification which went into effect in April, 1987, namely, the American Petroleum Institute's CE Specification. Therefore, the present invention provides a method for preparing a heavy duty diesel lubricating oil adapted for meeting the American Petroleum Institute CE specifications which comprises controlling the metal content of the oil to provide a total sulfated ash (SASH) level in said oil of less than about 0.6 wt. % and a SASH:dispersant weight:weight ratio of from 0.01:1 to about 0.2:1, and providing in said oil (A) at least about 3 wt. % ashless dispersant, (B) at least about 2 wt. % sulfurized alkyl phenol oxidation inhibitor, and (C) an antiwear effective amount of at least one metal salt of a dihydrocarbyl dithiophosphoric acid wherein each of said hydrocarbyl group in said acid has, on the average, at least 6 carbon atoms.

The present invention further provides a method for improving the performance of a heavy duty diesel lubricating oil adapted for use in a diesel engine provided with at least one tight top land piston, and preferably further adapted for being powered by a normally liquid fuel having a sulfur content of less than 1 wt. %, which comprises controlling the metal content of the oil to provide a total sulfated ash (SASH) level in said oil of less than about 0.6 wt. % and a SASH:dispersant weight:weight ratio of from 0.01:1 to about 0.2:1, and providing in said oil (A) at least about 3 wt. % ashless dispersant, (B) at least about 2 wt. % sulfurized alkyl phenol oxidation inhibitor, and (C) an antiwear effective amount of at least one metal salt of a dihydrocarbyl dithiophosphoric acid wherein each of said hydrocarbyl group in said acid has, on the average, at least 6 carbon atoms.

DETAILED DESCRIPTION OF THE INVENTION

Component A

Figure 1:
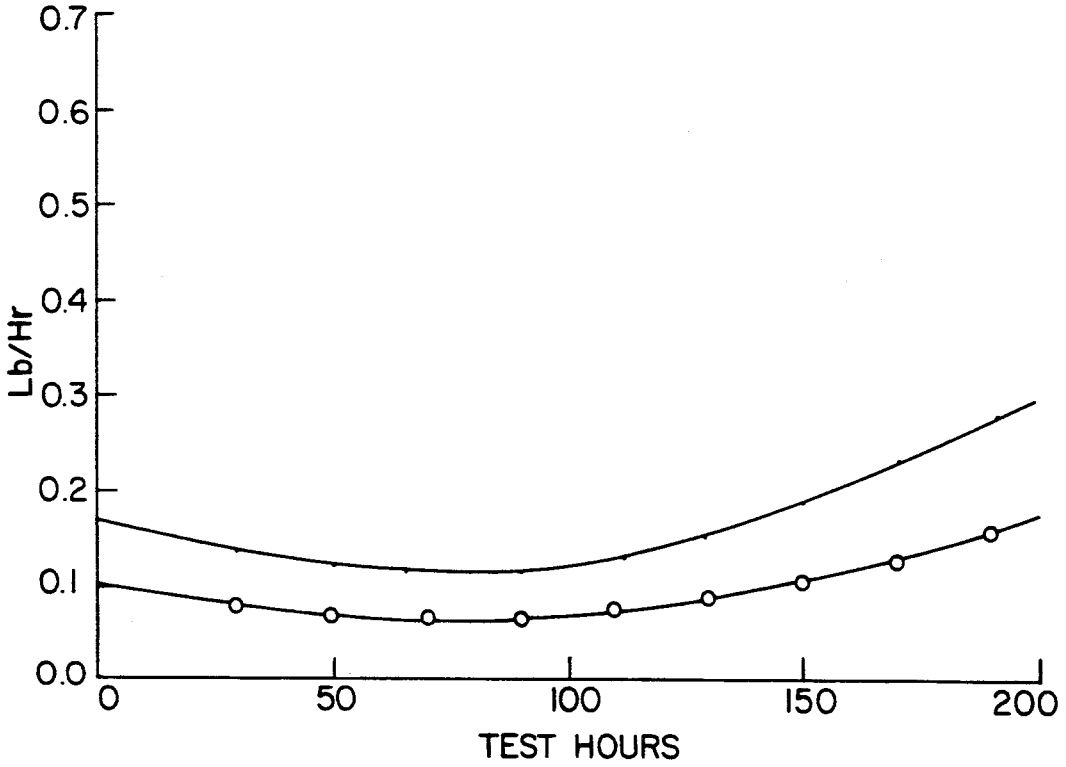
FIGURE 1 is a plot of oil consumption versus test hours in a NTC-400 oil consumption test, as summarized in Example 3.

Ashless, nitrogen or ester containing dispersants useful in this invention comprise boron-free members selected from the group consisting of (i) oil soluble salts, amides, imides, oxazolines and esters, or mixtures thereof, of long chain hydrocarbon substituted mono and dicarboxylic acids or their anhydrides; (ii) long chain aliphatic hydrocarbon having a polyamine attached directly thereto; and (iii) Mannich condensation products formed by condensing about a molar proportion of long chain hydrocarbon substituted phenol with about 1 to 2.5 moles of formaldehyde and about 0.5 to 2 moles of polyalkylene polyamine; wherein said long chain hydrocarbon group in (i), (ii) and (iii) is a polymer of a $C_2$ to $C_{10}$, e.g., $C_2$ to $C_5$ monoolefin, said polymer having a number average molecular weight of about 300 to about 5000.

A(i) The nitrogen- or ester- containing ashless dispersants comprise at least one member selected from the group consisting of oil soluble salts, amides, imides, oxazolines and esters, or mixtures thereof, of long chain hydrocarbon substituted mono and dicarboxylic acids or their anhydrides wherein said long chain hydrocarbon group is a polymer of a $C_2$ to $C_{10}$, e.g., $C_2$ to $C_5$, monoolefin, said polymer having a number average molecular weight of from about 700 to 5000.

The long chain hydrocarbyl substituted mono or dicarboxylic acid material, i.e. acid, anhydride, or ester, used in the dispersant includes long chain hydrocarbon generally a polyolefin, substituted with an average of at monocarboxylic acids and from about 0.8 to 2.0, preferably from about 1.0 to 1.6, e.g., 1.1 to 1.3 moles, per mole of polyolefin, of an alpha or beta- unsaturated $C_4$ to $C_{10}$ dicarboxylic acid, or anhydride or ester thereof. Exemplary of such dicarboxylic acids, anhydrides and esters thereof are fumaric acid, itaconic acid, maleic acid, maleic anhydride, chloromaleic acid, dimethyl fumarate, chloromaleic anhydride, acrylic acid, methacrylic acid, crotonic acid, cinnamic acid, etc.

Preferred olefin polymers for reaction with the unsaturated dicarboxylic acids to form the dispersants are polymers comprising a major molar amount of $C_2$ to $C_{10}$, e.g. $C_2$ to $C_5$ monoolefin. Such olefins include ethylene, propylene, butylene, isobutylene, pentene, octene-1, styrene, etc. The polymers can be homopolymers such as polyisobutylene, as well as copolymers of two or more of such olefins such as copolymers of: ethylene and propylene; butylene and isobutylene; propylene and isobutylene; etc. Other copolymers include those in which a minor molar amount of the copolymer monomers, e.g., 1 to 10 mole %, is a $C_4$ to $C_{18}$ non-conjugated diolefin, e.g., a copolymer of isobutylene and butadiene: or a copolymer of ethylene, propylene and 1,4-hexadiene; etc.

In some cases, the olefin polymer may be completely saturated, for example an ethylene-propylene copolymer made by a Ziegler-Natta synthesis using hydrogen as a moderator to control molecular weight.

The olefin polymers used in the dispersants will usually have number average molecular weights within the range of about 700 and about 5,000, more usually between about 800 and about 3000. Particularly useful olefin polymers have number average molecular weights within the range of about 900 and about 2500 with approximately one terminal double bond per polymer chain. An especially useful starting material for highly potent dispersant additives is polyisobutylene. The number average molecular weight for such polymers can be determined by several known techniques. A convenient method for such determination is by gel permeation chromatography (GPC) which additionally provides molecular weight distribution information, see W. W. Yau, J. J. Kirkland and D. D. Bly, "Modern Size Exclusion Liquid Chromatography", John Wiley and Sons, New York, 1979.

Processes for reacting the olefin polymer with the $C_{4-10}$ unsaturated dicarboxylic acid, anhydride or ester are known in the art. For example, the olefin polymer and the dicarboxylic acid material may be simply heated together as disclosed in U.S. Pat. Nos. 3,361,673 and 3,401,118 to cause a thermal "ene" reaction to take place Or, the olefin polymer can be first halogenated, for example, chlorinated or brominated to about 1 to 8 wt. %, preferably 3 to 7 wt. % chlorine, or bromine, based on the weight of polymer, by passing the chlorine or bromine through the polyolefin at a temperature of 60° to 250° C., e.g. 120° to 160° C., for about 0.5 to 10, preferably 1 to 7 hours. The halogenated polymer may then be reacted with sufficient unsaturated acid or anhydride at 100° to 250° C., usually about 180° to 235° C., for about 0.5 to 10, e.g. 3 to 8 hours, so the product obtained will contain the desired number of moles of the unsaturated acid per mole of the halogenated polymer. Processes of this general type are taught in U.S. Pat. Nos. 3,087,436; 3,172,892; 3,272,746 and others.

Alternatively, the olefin polymer, and the unsaturated acid material are mixed and heated while adding chlorine to the hot material Processes of this type are disclosed in U.S. Pat. Nos. 3,215,707; 3,231,587; 3,912,764; 4,110,349; 4,234,435; and in U.K. 1,440,219.

By the use of halogen, about 65 to 95 wt. % of the polyolefin, e.g. polyisobutylene will normally react with the dicarboxylic acid material. Upon carrying out a thermal reaction without the use of halogen or a catalyst, then usually only about 50 to 75 wt. % of the polyisobutylene will react Chlorination helps increase the reactivity. For convenience, the aforesaid functionality ratios of dicarboxylic acid producing units to polyolefin, e.g., 0.8 to 2.0, etc. are based upon the total amount of polyolefin, that is, the total of both the reacted and unreacted polyolefin, used to make the product.

The dicarboxylic acid producing materials can also be further reacted with amines, alcohols, including polyols, amino-alcohols, etc., to form other useful dispersant additives. Thus, if the acid producing material is to be further reacted, e.g., neutralized, then generally a major proportion of at least 50 percent of the acid units up to all the acid units will be reacted.

Amine compounds useful as nucleophilic reactants for neutralization of the hydrocarbyl substituted dicarboxylic acid materials include mono- and (preferably) polyamines, most preferably polyalkylene polyamines, of about 2 to 60, preferably 2 to 40 (e.g. 3 to 20), total carbon atoms and about 1 to 12, preferably 3 to 12, and most preferably 3 to 9 nitrogen atoms in the molecule. These amines may be hydrocarbyl amines or may be hydrocarbyl amines including other groups, e.g., hydroxy groups, alkoxy groups, amide groups, nitriles, imidazoline groups, and the like. Hydroxy amines with 1 to 6 hydroxy groups, preferably 1 to 3 hydroxy groups are particularly useful. Preferred amines are aliphatic saturated amines, including those of the general formulas:

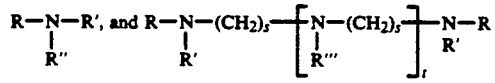

(I) (II)

wherein R, R', R'' and R''' are independently selected from the group consisting of hydrogen; $C_1$ to $C_{25}$ straight or branched chain alkyl radicals; $C_1$ to $C_{12}$ alkoxy $C_2$ to $C_6$ alkylene radicals; $C_2$ to $C_{12}$ hydroxy amino alkylene radicals; and $C_1$ to $C_{12}$ alkylamino $C_2$ to $C_6$ alkylene radicals; and wherein R''' can additionally comprise a moiety of the formula:

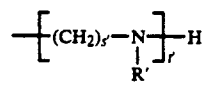

(III)

wherein R' is as defined above, and wherein s and s' can be the same or a different number of from 2 to 6, preferably 2 to 4; and t and t' can be the same or different and are numbers of from 0 to 10, preferably 2 to 7, and most preferably about 3 to 7, with the proviso that the sum of t and t' is not greater than 15. To assure a facile reaction, it is preferred that R, R', R'', R''', s, s', t and t' be selected in a manner sufficient to provide the compounds of Formulas I and II with typically at least one primary or secondary amine group, preferably at least two primary or secondary amine groups. This can be achieved by selecting at least one of said R, R', R'' or R''' groups to be hydrogen or by letting t in Formula IV be at least one when R''' is H or when the III moiety possesses a secondary amino group. The most preferred amine of the above formulas are represented by Formula II and contain at least two primary amine groups and at least one, and preferably at least three, secondary amine groups.

Non-limiting examples of suitable amine compounds include: 1,2-diaminoethane; 1,3-diaminopropane; 1,4-diaminobutane; 1,6-diaminohexane; polyethylene amines such as diethylene triamine; triethylene tetramine; tetraethylene pentamine; polypropylene amines such as 1,2-propylene diamine; di-(1,2-propylene)triamine; di-(1,3-propylene) triamine; N,N-dimethyl-1,3-diaminopropane; N,N-di-(2-aminoethyl) ethylene diamine; N,N-di(2-hydroxyethyl)-1,3-propylene diamine; 3-dodecyloxypropylamine; N-dodecyl-1,3-propane diamine; tris hydroxymethylaminomethane (THAM); diisopropanol amine; diethanol amine; triethanol amine; mono-, di-, and tri-tallow amines; amino morpholines such as N-(3-aminopropyl)morpholine; and mixtures thereof.

Other useful amine compounds include: alicyclic diamines such as 1,4-di(aminomethyl) cyclohexane, and heterocyclic nitrogen compounds such as imidazolines, and N-aminoalkyl piperazines of the general formula (IV):

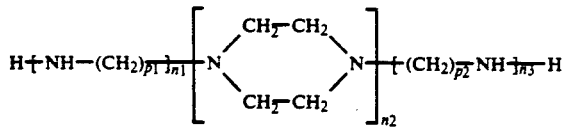

wherein $p_1$ and $p_2$ are the same or different and are each integers of from 1 to 4, and $n_1$, $n_2$ and $n_3$ are the same or different and are each integers of from 1 to 3. Non-limiting examples of such amines include 2-pentadecyl imidazoline; N-(2-aminoethyl) piperazine; etc.

Commercial mixtures of amine compounds may advantageously be used. For example, one process for preparing alkylene amines involves the reaction of an alkylene dihalide (such as ethylene dichloride or propylene dichloride) with ammonia, which results in a complex mixture of alkylene amines wherein pairs of nitrogens are joined by alkylene groups, forming such compounds as diethylene triamine, triethylenetetramine, tetraethylene pentamine and isomeric piperazines. Low cost poly(ethyleneamines) compounds averaging about 5 to 7 nitrogen atoms per molecule are available commercially under trade names such as "Polyamine H", "Polyamine 400", "Dow Polyamine E-100", etc.

Useful amines also include polyoxyalkylene polyamines such as those of the formulae:

$$NH_2\text{—alkylene}\text{-}(\text{O-alkylene})_m\text{-}NH_2 \quad \text{(V)}$$

where m has a value of about 3 to 70 and preferably 10 to 35; and $$R\text{-}(\text{alkylene}\text{-}(\text{O-alkylene})_n\text{-}NH_2)_a \quad \text{(VI)}$$

where "n" has a value of about 1 to 40 with the provision that the sum of all the n's is from about 3 to about 70 and preferably from about 6 to about 35, and R is a polyvalent saturated hydrocarbon radical of up to ten carbon atoms wherein the number of substituents on the R group is represented by the value of "a", which is a number of from 3 to 6. The alkylene groups in either formula (V) or (VI) may be straight or branched chains containing about 2 to 7, and preferably about 2 to 4 carbon atoms.

The polyoxyalkylene polyamines of formulas (V) or (VI) above, preferably polyoxyalkylene diamines and polyoxyalkylene triamines, may have average molecular weights ranging from about 200 to about 4000 and preferably from about 400 to about 2000 The preferred polyoxyalkylene polyoxyalkylene polyamines include the polyoxyethylene and polyoxypropylene diamines and the polyoxypropylene triamines having average molecular weights ranging from about 200 to 2000. The polyoxyalkylene polyamines are commercially available and may be obtained, for example, from the Jefferson Chemical Company, Inc. under the trade name "Jeffamines D-230, D-400, D-1000, D-2000, T-403", etc.

The amine is readily reacted with the selected dicarboxylic acid material, e.g. alkenyl succinic anhydride, by heating an oil solution containing 5 to 95 wt. % of dicarboxylic acid material to about 100° to 250° C., preferably 125° to 175° C., generally for 1 to 10, e.g. 2 to 6 hours until the desired amount of water is removed. The heating is preferably carried out to favor formation of imides or mixtures of imides and amides, rather than amides and salts. Reaction ratios of dicarboxylic material to equivalents of amine as well as the other nucleophilic reactants described herein can vary considerably, depending on the reactants and type of bonds formed. Generally from 0.1 to 1.0, preferably from about 0.2 to 0.6, e.g., 0.4 to 0.6, moles of dicarboxylic acid moiety content (e.g., grafted maleic anhydride content) is used per equivalent of nucleophilic reactant, e.g., amine. For example, about 0.8 mole of a pentaamine (having two primary amino groups and five equivalents of nitrogen per molecule) is preferably used to convert into a mixture of amides and imides, the product formed by reacting one mole of olefin with sufficient maleic anhydride to add 1.6 moles of succinic anhydride groups per mole of olefin, i.e., preferably the pentaamine is used in an amount sufficient to provide about 0.4 mole (that is, 1.6 divided by (0.8×5) mole) of succinic anhydride moiety per nitrogen equivalent of the amine.

The nitrogen containing dispersants can be further treated by boration as generally taught in U.S. Pat. Nos. 3,087,936 and 3,254,025 (incorporated herein by reference thereto). This is readily accomplished by treating the selected acyl nitrogen dispersant with a boron compound selected from the class consisting of boron oxide, boron halides, boron acids and esters of boron acids in an amount to provide from about 0.1 atomic proportion of boron for each mole of said acylated nitrogen composition to about 20 atomic proportions of boron for each atomic proportion of nitrogen of said acylated nitrogen composition. Usefully the dispersants of the inventive combination contain from about 0.05 to 2.0 wt. %, e.g. 0.05 to 0.7 wt. % boron based on the total weight of said borated acyl nitrogen compound The boron, which appears to be in the product as dehydrated boric acid polymers (primarily $(HBO_2)_3$), is believed to attach to the dispersant imides and diimides as amine salts, e.g., the metaborate salt of said diimide.

Treating is readily carried out by adding from about 0.05 to 4, e.g. 1 to 3 wt. % (based on the weight of said acyl nitrogen compound) of said boron compound, preferably boric acid which is most usually added as a slurry to said acyl nitrogen compound and heating with stirring at from about 135° C. to 190°, e.g. 140°-170° C., for from 1 to 5 hours followed by nitrogen stripping at said temperature ranges. Or, the boron treatment can be carried out by adding boric acid to the hot reaction mixture of the dicarboxylic acid material and amine while removing water.

The tris(hydroxymethyl) amino methane (THAM) can be reacted with the aforesaid acid material to form amides, imides or ester type additives as taught by U.K. 984,409, or to form oxazoline compounds and borated oxazoline compounds as described, for example, in U.S. Pat. Nos. 4,102,798; 4,116,876 and 4,113,639.

The ashless dispersants may also be esters derived from the aforesaid long chain hydrocarbon substituted dicarboxylic acid material and from hydroxy compounds such as monohydric and polyhydric alcohols or aromatic compounds such as phenols and naphthols, etc. The polyhydric alcohols are the most preferred hydroxy compound and preferably contain from 2 to about 10 hydroxy radicals, for example, ethylene glycol, diethylene glycol, triethylene glycol, tetraethylene glycol, dipropylene glycol, and other alkylene glycols in which the alkylene radical contains from 2 to about 8 carbon atoms. Other useful polyhydric alcohols include glycerol, mono-oleate of glycerol, monostearate of glycerol, monomethyl ether of glycerol, pentaerythritol, dipentaerythritol, and mixtures thereof.

The ester dispersant may also be derived from unsaturated alcohols such as allyl alcohol, cinnamyl alcohol, propargyl alcohol, 1-cyclohexane-3-ol, and oleyl alcohol. Still other classes of the alcohols capable of yielding the esters of this invention comprise the ether-alcohols and amino-alcohols including, for example, the oxy-alkylene, oxy-arylene-, amino-alkylene-, and amino-arylene-substituted alcohols having one or more oxy-alkylene, amino-alkylene or amino-arylene oxy-arylene radicals. They are exemplified by Cellosolve, Carbitol, N,N,N',N'-tetrahydroxy-trimethylene diamine, and ether-alcohols having up to about 150 oxy-alkylene radicals in which the alkylene radical contains from 1 to about 8 carbon atoms.

The ester dispersant may be di-esters of succinic acids or acidic esters, i.e., partially esterified succinic acids; as well as partially esterified polyhydric alcohols or phenols, i.e., esters having free alcohols or phenolic hydroxyl radicals Mixtures of the above illustrated esters likewise are contemplated within the scope of this invention.

The ester dispersant may be prepared by one of several known methods as illustrated for example in U.S. Pat. No. 3,381,022. The ester dispersants may also be borated, similar to the nitrogen containing dispersants, as described above.

Hydroxyamines which can be reacted with the aforesaid long chain hydrocarbon substituted dicarboxylic acid materials to form dispersants include 2-amino-1-butanol, 2-amino-2-methyl-1-propanol, p-(beta-hydroxyethyl)-aniline, 2-amino-1-propanol, 3-amino-1-propanol, 2-amino-2-methyl-1, 3-propane-diol, 2-amino-2-ethyl-1, 3-propanediol, N-(beta-hydroxy-propyl)-N'-(beta-aminoethyl)-piperazine, tris(hydroxymethyl) amino-methane (also known as trismethylolaminomethane), 2-amino-1-butanol, ethanolamine, beta-(beta-hydroxyethoxy)ethylamine, and the like. Mixtures of these or similar amines can also be employed. The above description of nucleophilic reactants suitable for reaction with the hydrocarbyl substituted dicarboxylic acid or anhydride includes amines, alcohols, and compounds of mixed amine and hydroxy containing reactive functional groups, i.e., amino-alcohols.

A preferred group of ashless dispersants are those derived from polyisobutylene substituted with succinic anhydride groups and reacted with polyethylene amines, e.g. tetraethylene pentamine, pentaethylene hexamine, polyoxyethylene and polyoxypropylene amines, e.g. polyoxypropylene diamine, trismethylolaminomethane and pentaerythritol, and combinations thereof. One particularly preferred dispersant combination involves a combination of (i) polyisobutene substituted with succinic anhydride groups and reacted with (ii) a hydroxy compound, e.g. pentaerythritol, (iii) a polyoxyalkylene polyamine, e.g. polyoxypropylene diamine, and iv) a polyalkylene polyamine, e.g. polyethylene diamine and tetraethylene pentamine using about 0.3 to about 2 moles each of (ii) and (iv) and about 0.3 to about 2 moles of (iii) per mole of (i) as described in U.S. Pat. No. 3,804,763. Another preferred dispersant combination involves the combination of (i) polyisobutenyl succinic anhydride with (ii) a polyalkylene polyamine, e.g. tetraethylene pentamine, and (iii) a polyhydric alcohol or polyhydroxy-substituted aliphatic primary amine, e.g. pentaerythritol or trismethylolaminomethane as described in U.S. Pat. No. 3,632,511.

A(ii) Also useful as ashless nitrogen-containing dispersant in this invention are dispersants wherein a nitrogen containing polyamine is attached directly to the long chain aliphatic hydrocarbon as shown in U.S. Pat. Nos. 3,275,554 and 3,565,804 where the halogen group on the halogenated hydrocarbon is displaced with various alkylene polyamines.

A(iii) Another class of nitrogen containing dispersants which may be used are those containing Mannich base or Mannich condensation products as they are known in the art. Such Mannich condensation products generally are prepared by condensing about 1 mole of a high molecular weight hydrocarbyl substituted mono- or polyhydroxy benzene (e.g., having a number average molecular weight of 1,000 or greater) with about to 2.5 moles of formaldehyde or paraformaldehyde and about 0.5 to 2 moles polyalkylene polyamine as disclosed, e.g., in U.S. Pat. Nos. 3,442,808; 3,649,229 and 3,798,165 (the disclosures of which are hereby incorporated by reference in their entirety). Such Mannich condensation products may include a long chain, high molecular weight hydrocarbon on the phenol group or may be reacted with a compound containing such a hydrocarbon, e.g., polyalkenyl succinic anhydride as shown in said aforementioned U.S. Pat. No. 3,442,808.

Component B

Component B of the compositions of this invention is at least one sulfurized alkyl phenol as oxidation inhibitor. Sulfurized alkyl phenols and the methods of preparing them are known in the art and are disclosed, for example, in the following U.S. Pat. Nos. (which are incorporated by reference herein) 2,139,766; 2,198,828; 2,230,542; 2,836,565; 3,285,854; 3,538,166; 3,844,956; and 3,951,830.

In general, the sulfurized alkyl phenol may be prepared by reacting an alkyl phenol with a sulfurizing agent such as elemental sulfur, a sulfur halide (e.g., sulfur monochloride or sulfur dichloride), a mixture of hydrogen sulfide and sulfur dioxide, or the like. The preferred sulfurizing agents are sulfur and the sulfur halides, and especially the sulfur chlorides, with sulfur dichloride ($SCl_2$) being especially preferred.

The alkyl phenols which are sulfurized to produce Component B are generally compounds containing at least one hydroxy group (e.g., from 1 to 3 hydroxy groups) and at least one alkyl radical (e.g., from 1 to 3 alkyl radicals) attached to the same aromatic ring. The alkyl radical ordinarily contains about 3–100 and preferably about 6–20 carbon atoms. The alkyl phenol may contain more than one hydroxy group as exemplified by alkyl resorcinols, hydroquinones and catechols, or it may contain more than one alkyl radical; but normally it contains only one of each. Compounds in which the alkyl and hydroxy groups are ortho, meta and para to each other, and mixtures of such compounds, are within the scope of the invention. Illustrative alkyl phenols are n-propylphenol, isopropylphenol, n-butylphenol, t-butylphenol, hexylphenol, heptylphenol, octylphenol, nonylphenol, n-dodecylphenol, (propene tetramer)-substituted phenol, octadecylphenol, eicosylphenol, polybutene (molecular weight about 1000)-substituted phenol, n-dodecylresorcinol and 2,4-di-t-butylphenol. Also included are methylene-bridged alkyl phenols of the type which may be prepared by the reaction of an alkyl phenol with formaldehyde or a formaldehyde-yielding reagent such as trioxane or paraformaldehyde.

The sulfurized alkyl phenol is typically prepared by reacting the alkyl phenol with the sulfurizing agent at a temperature within the range of about 100°-250° C. The reaction may take place in a substantially inert diluent such as toluene, xylene, petroleum naphtha, mineral oil, Cellosolve or the like. If the sulfurizing agent is a sulfur halide, and especially if no diluent is used, it is frequently preferred to remove acidic materials such as hydrogen halides by vacuum stripping the reaction mixture or blowing it with an inert gas such as nitrogen. If the sulfurizing agent is sulfur, it is frequently advantageous to blow the sulfurized product with an inert gas such as nitrogen or air so as to remove sulfur oxides and the like.

Component C

Component C of the compositions of this invention is an anti-wear agent comprising at least one metal salt of at least one dihydrocarbyl dithiophosphoric acid wherein the hydrocarbyl groups contain an average of at least 6 carbon atoms.

The acids from which the metal salts can be derived can be illustrated by acids of the formula

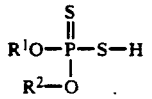

wherein $R^1$ and $R^2$ are the same or different and are alkyl, cycloalkyl, aralkyl, alkaryl or substituted substantially hydrocarbon radical derivatives of any of the above groups, and wherein the $R^1$ and $R^2$ groups in the acid each have, on average, at least 6 carbon atoms.

By "substantially hydrocarbon" is meant radicals containing substituent groups (e.g., to 4 substituent groups per radical moiety) such as ether, ester, nitro or halogen which do not materially affect the hydrocarbon character of the radical Specific examples of suitable $R^1$ and $R^2$ radicals include isopropyl, isobutyl, n-butyl, sec-butyl, n-hexyl, heptyl, 2-ethylhexyl, diisobutyl, isooctyl, decyl, dodecyl, tetradecyl, hexadecyl, octadecyl, butylphenyl, o,p-depentylphenyl, octylphenyl, polyisobutene-(molecular weight 350)-substituted phenyl, tetrapropylene-substituted phenyl, beta-octylbutylnaphthyl, cyclopentyl, cyclohexyl, phenyl, chlorophenyl, o-dichlorophenyl, bromophenyl, naphthenyl, 2-methylcyclohexyl, benzyl, chlorobenzyl, chloropentyl, dichlorophenyl, nitrophenyl, dichlorodecyl and xenyl radicals. Alkyl radicals having about 6-30 carbon atoms, and aryl radicals having about 6-30 carbon atoms, are preferred. Particularly preferred $R^1$ and $R^2$ radicals are alkyl of 6 to 18 carbons.

The phosphorodithioic acids are readily obtainable by the reaction of phosphorus pentasulfide and an alcohol or phenol. The reaction involves mixing, at a temperature of about 20°-200° C., 4 moles of the alcohol or phenol with one mole of phosphorus pentasulfide. Hydrogen sulfide is liberated as the reaction takes place.

The metal salts which are useful in this invention include those salts containing Group I metals, Group II metals, aluminum, lead, tin, molybdenum, manganese, cobalt and nickel. Zinc is the preferred metal. Examples of metal compounds which may be reacted with the acid include lithium oxide, lithium hydroxide, lithium carbonate, lithium pentylate, sodium oxide, sodium hydroxide, sodium carbonate, sodium methylate, sodium propylate, sodium phenoxide, potassium oxide, potassium hydroxide, potassium carbonate, potassium methylate, silver oxide, silver carbonate, magnesium oxide, magnesium hydroxide, magnesium carbonate, magnesium ethylate, magnesium propylate, magnesium phenoxide, calcium oxide, calcium hydroxide, calcium carbonate, calcium methylate, calcium propylate, calcium pentylate, zinc oxide, zinc hydroxide, zinc carbonate, zinc propylate, strontium oxide, strontium hydroxide, cadmium oxide, cadmium hydroxide, cadmium carbonate, cadmium ethylate, barium oxide, barium hydroxide, barium hydrate, barium carbonate, barium ethylate, barium pentylate, aluminum oxide, aluminum propylate, lead oxide, lead hydroxide, lead carbonate, tin oxide, tin butylate, cobalt oxide, cobalt hydroxide, cobalt carbonate, cobalt pentylate, nickel oxide, nickel hydroxide and nickel carbonate.

In some instances, the incorporation of certain ingredients, particularly carboxylic acids or metal carboxylates such as small amounts of the metal acetate or acetic acid used in conjunction with the metal reactant will facilitate the reaction and result in an improved product. For example, the use of up to about 5% of zinc acetate in combination with the required amount of zinc oxide facilitates the formation of a zinc phosphorodithioate.

The preparation of metal phosphorodithioates is well known in the art and is described in a large number of issued patents, including U.S. Pat. Nos. 3,293,181; 3,397,145; 3,396,109; and 3,442,804, the disclosures of which are hereby incorporated by reference insofar as the preparation of metal salts of organic phosphorodithioic acids useful in this invention are described.

LUBRICATING COMPOSITIONS

Lubricating oil compositions, e.g. automatic transmission fluids, heavy duty oils suitable for diesel engines (that is, compression ignition engines), etc., can be prepared with the additives of the invention. Universal type crankcase oils wherein the same lubricating oil compositions can be used for both gasoline and diesel engine can also be prepared. These lubricating oil formulations conventionally contain several different types of additives that will supply the characteristics that are required in the formulations. Among these types of additives are included viscosity index improvers, antioxidants, corrosion inhibitors, detergents, pour point depressants, other antiwear agents, etc., provided the fully formulated oil satisfies the low total SASH requirements of this invention.

In the preparation of heavy duty diesel lubricating oil formulations it is common practice to introduce the additives in the form of 10 to 80 wt. %, e.g. 20 to 80 wt. % active ingredient concentrates in hydrocarbon oil, e.g. mineral lubricating oil, or other suitable solvent. Usually these concentrates may be diluted with 3 to 100, e.g. 5 to 40 parts by weight of lubricating oil, per part by weight of the additive package, in forming finished lubricants, e.g. crankcase motor oils. The purpose of concentrates, of course, is to make the handling of the various materials less difficult and awkward as well as to facilitate solution or dispersion in the final blend. Thus, a Component A ashless dispersant would be usually employed in the form of a 40 to 50 wt. % concentrate, for example, in a lubricating oil fraction.

Components A, B and C of the present invention will be generally used in admixture with a lube oil basestock, comprising an oil of lubricating viscosity, including natural and synthetic lubricating oils and mixtures thereof.

Components A, B and C can be incorporated into a lubricating oil in any convenient way. Thus, these mixtures can be added directly to the oil by dispersing or dissolving the same in the oil at the desired level of concentrations of the detergent inhibitor and antiwear agent, respectively. Such blending into the additional lube oil can occur at room temperature or elevated temperatures. Alternatively, the Components A, B and C can be blended with a suitable oil-soluble solvent and base oil to form a concentrate, and then blending the concentrate with a lubricating oil basestock to obtain the final formulation, i.e., the fully formulated lubricating oil composition. Such concentrates will typically contain (on an active ingredient (A.I.) basis) from about 10 to about 40 wt. %, and preferably from about 20 to about 35 wt. %, Component A ashless dispersant additive, typically from about 10 to 40 wt. %, preferably from about 15 to 25 wt. % Component B antioxidant additive, typically from about 5 to 15 wt. %, and preferably from about 7 to 12 wt. %, Component C antiwear additive, and typically from about 30 to 80 wt. %, preferably from about 40 to 60 wt. %, base oil, based on the concentrate weight.

The fully formulated lubricating oil compositions of this invention are also characterized (1) by a total sulfate ash value (SASH) concentration of from 0.01 to about 0.6 wt. % SASH, preferably from about 0.1 to about 0.5 wt. % SASH, and more preferably from about 0.2 to about 0.45 wt. % SASH; and (2) by a wt. % SASH to wt. % Component A ratio of from about 0.01:1 to about 0.2:1, preferably from about 0.02:1 to 0.15:1, and more preferably from about 0.03:1 to 0.1:1. By "total sulfated ash" herein is meant the total weight % of ash which is determined for a given oil (based on the oil's metallic components) by ASTM D874.

The lubricating oil basestock for Components A, B and C typically is adapted to perform a selected function by the incorporation of additional additives therein to form lubricating oil compositions (i.e., formulations).

Natural oils include animal oils and vegetable oils (e.g., castor, lard oil) liquid petroleum oils and hydrorefined, solvent-treated or acid-treated mineral lubricating oils of the paraffinic, naphthenic and mixed paraffinic-naphthenic types. Oils of lubricating viscosity derived from coal or shale are also useful base oils Alkylene oxide polymers and interpolymers and derivatives thereof where the terminal hydroxyl groups have been modified by esterification, etherification, etc., constitute another class of known synthetic lubricating oils. These are exemplified by polyoxyalkylene polymers prepared by polymerization of ethylene oxide or propylene oxide, the alkyl and aryl ethers of these polyoxyalkylene polymers (e.g., methyl-poly isopropylene glycol ether having an average molecular weight of 1000, diphenyl ether of poly-ethylene glycol having a molecular weight of 500–1000, diethyl ether of polypropylene glycol having a molecular weight of 1000–1500) ; and mono- and polycarboxylic esters thereof, for example, the acetic acid esters, mixed $C_3$–$C_8$ fatty acid esters and $C_{13}$ Oxo acid diester of tetraethylene glycol.

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids) with a variety of alcohols (e.g., butyl alcohol, hexyl alcohol, dodecyl alcohol, 2-ethylhexyl alcohol, ethylene glycol, diethylene glycol monoether, propylene glycol). Specific examples of these esters include dibutyl adipate, di(2-ethylhexyl)sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols and polyol ethers such as neopentyl glycol, trimethylolpropane, pentaerythritol, dipentaerythritol and tripentaerythritol.

Silicon-based oils such as the polyalkyl-, polyaryl-, polyalkoxy-, or polyaryloxysiloxane oils and silicate oils comprise another useful class of synthetic lubricants ; they include tetraethyl silicate, tetraisopropyl silicate, tetra-(2-ethylhexyl) silicate, tetra-(4-methyl-2-ethylhexyl) silicate, tetra-(p-tert-butylphenyl) silicate, hexa-(4-methyl-2-pentoxy) disiloxane, poly(methyl) siloxanes and poly(methylphenyl) siloxanes. Other synthetic lubricating oils include liquid esters of phosphorus-containing acids (e.g., tricresyl phosphate, trioctyl phosphate, diethyl ester of decylphosphonic acid) and polymeric tetrahydrofurans.

Unrefined, refined and rerefined oils can be used in the lubricants of the present invention. Unrefined oils are those obtained directly from a natural or synthetic source without further purification treatment. For example, a shale oil obtained directly from retorting operations, a petroleum oil obtained directly from distillation or ester oil obtained directly from an esterification process and used without further treatment would be an unrefined oil. Refined oils are similar to the unrefined oils except they have been further treated in one or more purification steps to improve one or more properties. Many such purification techniques, such as distillation, solvent extraction, acid or base extraction, filtration and percolation are known to those skilled in the art. Rerefined oils are obtained by processes similar to those used to obtain refined oils applied to refined oils which have been already used in service. Such rerefined oils are also known as reclaimed or reprocessed oils and often are additionally processed by techniques for removal of spent additives and oil breakdown products.

The novel compositions of the present invention can be used with V.I improvers to form multi-grade diesel engine lubricating oils. Viscosity modifiers impart high and low temperature operability to the lubricating oil and permit it to remain relatively viscous at elevated temperatures and also exhibit acceptable viscosity or fluidity at low temperatures. Viscosity modifiers are generally high molecular weight hydrocarbon polymers including polyesters. The viscosity modifiers may also be derivatized to include other properties or functions, such as the addition of dispersancy properties. These oil soluble viscosity modifying polymers will generally have number average molecular weights of from $10^3$ to $10^6$, preferably $10^4$ to $10^6$, e.g., 20,000 to 250,000, as determined by gel permeation chromatography or osmometry.

Examples of suitable hydrocarbon polymers include homopolymers and copolymers of two or more monomers of $C_2$ to $C_{30}$, e.g. $C_2$ to $C_8$ olefins, including both alpha olefins and internal olefins, which may be straight or branched, aliphatic, aromatic, alkyl-aromatic, cycloaliphatic, etc. Frequently they will be of ethylene with $C_3$ to $C_{30}$ olefins, particularly preferred being the copolymers of ethylene and propylene. Other polymers can be used such as polyisobutylenes, homopolymers and copolymers of $C_6$ and higher alpha olefins, atactic polypropylene, hydrogenated polymers and copolymers and terpolymers of styrene, e.g. with isoprene and/or butadiene and hydrogenated derivatives thereof. The polymer may be degraded in molecular weight, for example by mastication, extrusion, oxidation or thermal degradation, and it may be oxidized and contain oxygen. Also included are derivatized polymers such as post-grafted interpolymers of ethylene-propylene with an active monomer such as maleic anhydride which may be further reacted with an alcohol, or amine, e.g. an alkylene polyamine or hydroxy amine, e.g. see U.S. Pat. No. Nos. 4,089,794; 4,160,739; 4,137,185; or copolymers of ethylene and propylene reacted or grafted with nitrogen compounds such as shown in U.S. Pat. Nos. 4,068,056; 4,068,058; 4,146,489 and 4,149,984.

The preferred hydrocarbon polymers are ethylene copolymers containing from 15 to 90 wt. % ethylene, preferably 30 to 80 wt. % of ethylene and 10 to 85 wt. %, preferably 20 to 70 wt. % of one or more $C_3$ to $C_{28}$, preferably $C_3$ to $C_{18}$, more preferably $C_3$ to $C_8$, alpha-olefins While not essential, such copolymers preferably have a degree of crystallinity of less than 25 wt. %, as determined by X-ray and differential scanning calorimetry. Copolymers of ethylene and propylene are most preferred. Other alpha-olefins suitable in place of propylene to form the copolymer, or to be used in combination with ethylene and propylene, to form a terpolymer, tetrapolymer, etc. , include 1-butene, 1-pentene, 1-hexene, 1-heptene, 1-octene, 1-nonene, 1-decene, etc.; also branched chain alpha-olefins, such as 4-methyl-1-pentene, 4-methyl-1-hexene, 5-methylpentene-1, 4,4-dimethyl-1-pentene, and 6-methylheptene-1, etc., and mixtures thereof.

Terpolymers, tetrapolymers, etc., of ethylene, said $C_3$–$C_{28}$ alpha-olefin, and a non-conjugated diolefin or mixtures of such diolefins may also be used. The amount of the non-conjugated diolefin generally ranges from about 0.5 to 20 mole percent, preferably from about 1 to about 7 mole percent, based on the total amount of ethylene and alpha-olefin present.

The polyester V.I. improvers are generally polymers of esters of ethylenically unsaturated $C_3$ to $C_8$ mono- and dicarboxylic acids such as methacrylic and acrylic acids, maleic acid, maleic anhydride, fumaric acid, etc.

Examples of unsaturated esters that may be used include those of aliphatic saturated mono alcohols of at least 1 carbon atom and preferably of from 12 to 20 carbon atoms, such as decyl acrylate, lauryl acrylate, stearyl acrylate, eicosanyl acrylate, docosanyl acrylate, decyl methacrylate, diamyl fumarate, lauryl methacrylate, cetyl methacrylate, stearyl methacrylate, and the like and mixtures thereof.

Other esters include the vinyl alcohol esters of $C_2$ to $C_{22}$ fatty or mono carboxylic acids, preferably saturated such as vinyl acetate, vinyl laurate, vinyl palmitate, vinyl stearate, vinyl oleate, and the like and mixtures thereof. Copolymers of vinyl alcohol esters with unsaturated acid esters such as the copolymer of vinyl acetate with dialkyl fumarates, can also be used.

The esters may be copolymerized with still other unsaturated monomers such as olefins, e.g. 0.2 to 5 moles of $C_2$–$C_{20}$ aliphatic or aromatic olefin per mole of unsaturated ester, or per mole of unsaturated acid or anhydride followed by esterification. For example, copolymers of styrene with maleic anhydride esterified with alcohols and amines are known, e.g., see U.S. Pat. No. 3,702,300.

Such ester polymers may be grafted with, or the ester copolymerized with, polymerizable unsaturated nitrogen-containing monomers to impart dispersancy to the V.I. improvers. Examples of suitable unsaturated nitrogen-containing monomers include those containing 4 to 20 carbon atoms such as amino substituted olefins as p-(beta-diethylaminoethyl)styrene; basic nitrogen-containing heterocycles carrying a polymerizable ethylenically unsaturated substituent, e.g. the vinyl pyridines and the vinyl alkyl pyridines such as 2-vinyl-5-ethyl pyridine, 2-methyl-5-vinyl pyridine, 2-vinyl-pyridine, 4-vinyl-pyridine, 3-vinyl-pyridine, 3-methyl-5-vinyl-pyridine, 4-methyl-2-vinyl-pyridine, 4-ethyl-2-vinyl-pyridine and 2-butyl-1-5-vinyl-pyridine and the like.

N-vinyl lactams are also suitable, e.g. N-vinyl pyrrolidones or N-vinyl piperidones.

The vinyl pyrrolidones are preferred and are exemplified by N-vinyl pyrrolidone, N-(1-methylvinyl) pyrrolidone, N-vinyl-5-methyl pyrrolidone, N-vinyl-3, 3-dimethylpyrrolidone, N-vinyl-5-ethyl pyrrolidone, etc.

Metal detergent inhibitors are generally basic (viz, overbased) alkali or alkaline earth metal salts (or mixtures thereof, e.g. mixtures of Ca and Mg salts) of one or more organic sulfonic acid (generally a petroleum sulfonic acid or a synthetically prepared alkaryl sulfonic acid), petroleum naphthenic acids, alkyl benzene sulfonic acids, alkyl phenols, alkylene-bis-phenols, oil soluble fatty acids and the like, such as are described in U.S. Pat. Nos. 2,501,731; 2,616,904; 2,616,905; 2,616,906; 2,616,911; 2,616,924; 2,616,925; 2,617,049; 2,777,874; 3,027,325; 3,256,186; 3,282,835; 3,384,585; 3,373,108; 3,365,396; 3,342,733; 3,320,162; 3,312,618; 3,318,809; and 3,562,159. For purposes of illustration, the disclosures of the above patents are hereby incorporated in the present specification insofar as the complexes useful in this invention are described. Among the petroleum sulfonates, the most useful products are those prepared by the sulfonation of suitable petroleum fractions with subsequent removal of acid sludge and purification. Synthetic alkaryl sulfonic acids are usually prepared from alkylated benzenes such as the Friedel-Crafts reaction product of benzene and a polymer such as tetrapropylene, $C_{18}$–$C_{24}$ hydrocarbon polymer, etc. Suitable acids may also be obtained by sulfonation of alkylated derivatives of such compounds as diphenylene oxide thianthrene, phenolthioxine, diphenylene sulfide, phenothiazine, diphenyl oxide, diphenyl sulfide, diphenylamine, cyclohexane, decahydro naphthalene and the like.

Highly basic alkali and alkaline earth metal sulfonates are frequently used as detergents. They are usually produced by heating a mixture comprising an oil-soluble sulfonate or alkaryl sulfonic acid, with an excess of alkali and/or alkaline earth metal compound above that required for complete neutralization of any sulfonic acid present and thereafter forming a dispersed carbonate complex by reacting the excess metal with carbon dioxide to provide the desired overbasing. The sulfonic acids are typically obtained by the sulfonation of alkyl substituted aromatic hydrocarbons such as those obtained from the fractionation of petroleum by distillation and/or extraction or by the alkylation of aromatic hydrocarbons as for example those obtained by alkylating benzene, toluene, xylene, naphthalene, diphenyl and the halogen derivatives such as chlorobenzene, chlorotoluene and chloronaphthalene. The alkylation may be carried out in the presence of a catalyst with alkylating agents having from about 3 to more than 30 carbon atoms. For example haloparaffins, olefins obtained by dehydrogenation of paraffins, polyolefins produced from ethylene, propylene, etc. are all suitable The alkaryl sulfonates usually contain from about 9 to about 70 or more carbon atoms, preferably from about 16 to about 50 carbon atoms per alkyl substituted aromatic moiety.

The alkaline earth metal compounds which may be used in neutralizing these alkaryl sulfonic acids to provide the sulfonates includes the oxides and hydroxides, alkoxides, carbonates, carboxylate, sulfide, hydrosulfide, nitrate, borates and ethers of magnesium, calcium, and barium, sodium, lithium and potassium. Examples are calcium oxide, calcium hydroxide, magnesium acetate and magnesium borate. As noted, the alkaline earth metal compound is used in excess of that required to complete neutralization of the alkaryl sulfonic acids. Generally, the amount ranges from about 100 to 220%, although it is preferred to use at least 125%, of the stoichiometric amount of metal required for complete neutralization.

Various other preparations of basic alkaline earth metal alkaryl sulfonates are known, such as U.S. Pat. Nos. 3,150,088 and 3,150,089 wherein overbasing is accomplished by hydrolysis of an alkoxide-carbonate complex with the alkaryl sulfonate in a hydrocarbon solvent-diluent oil.

A preferred Mg sulfonate additive is magnesium alkyl aromatic sulfonate having a total base number ranging from about 250 to about 400 with the magnesium sulfonate content ranging from about 25 to about 32 wt. %, based upon the total weight of this additive system dispersed in mineral lubricating oil. A preferred Ca sulfonate additive is calcium alkyl aromatic sulfonate having a total base number ranging from about 250 to about 500 with the calcium sulfonate content ranging from about 25 to about 32 wt. %, based upon the total weight of this additive system dispersed in mineral lubricating oil.

As an example of a particularly convenient process for the preparation of the complexes used, an oil-soluble sulfonic acid, such as a synthetically prepared didodecylbenzene sulfonic acid, is mixed with an excess of lime (e.g., 10 equivalents per equivalent of the acid) and a promoter such as methanol, heptylphenol, or mixture thereof, and a solvent such as mineral oil, at 50° C.-150° C. and the process mass is then carbonated until a homogeneous mass is obtained. Complexes of sulfonic acids, carboxylic acids, and mixtures thereof are obtainable by processes such as are described in U.S. Pat. No. 3,312,618. Another example is the preparation of a magnesium sulfonate normal magnesium salt thereof, an excess of magnesium oxide, water, and preferably also an alcohol such as methanol.

The carboxylic acids useful for preparing sulfonate carboxylate complexes, and carboxylate complexes, i.e., those obtainable from processes such as the above wherein a mixture of sulfonic acid and carboxylic acid or a carboxylic acid alone is used in lieu of the sulfonic acid, are oil-soluble acids and include primarily fatty acids which have at least about 12 aliphatic carbon atoms and not more than about 24 aliphatic carbon atoms. Examples of these acids include palmitic, stearic, myristic, oleic, linoleic, dodecanoic, behenic, etc. Cyclic carboxylic acids may also be employed These include aromatic and cyclo-aliphatic acids. The aromatic acids are those containing a benzenoid structure (i.e., benzene, naphthalene, etc.) and an oil-solubilizing radical or radicals having a total of at least about 15 to 18 carbon atoms, preferably from about 15 to about 200 carbon atoms. Examples of the aromatic acids include: stearyl-benzoic acid, phenyl stearic acid, mono- or poly-wax-substituted benzoic or naphthoic acids wherein the wax group consists of at least about 18 carbon atoms, cetyl hydroxybenzoic acids, etc. The cycloaliphatic acids contemplated have at least about 12, usually up to about 30 carbon atoms. Examples of such acids are petroleum naphthenic acids, cetyl cyclohexane carboxylic acids, di-lauryl decahydronaphthalene carboxylic acids, di-octyl cyclopentane carboxylic acids, etc. The thiocarboxylic acid analogs of the above acids, wherein one or both of the oxygen atoms of the carboxyl group are replaced by sulfur, are also contemplated.

The ratio of the sulfonic acid to the carboxylic acid in mixtures is at least 1:1 (on a chemical equivalent basis) and is usually less than 5:1, preferably from 1:1 to 2:1.

The terms "basic salt" and "overbased salt" are used to designate metal salts wherein the metal is present in stoichiometrically larger amounts than the sulfonic acid radical.

As used in the present specification, the term "complex" refers to basic metal salts which contain metal in an amount in excess of that present in a neutral or normal metal salt. The "base number" of a complex is the number of milligrams of KOH to which one gram of the complex is equivalent as measured by titration. The commonly employed methods for preparing the basic salts involve heating a mineral oil solution of the normal metal salt of the acid with a metal neutralizing agent such as the oxide, hydroxide, carbonate, bicarbonate or sulfide at a temperature above 5° C. and filtering the resulting mass. The use of a "promoter" in the neutralization step to aid the incorporation of a large excess of metal is known and is preferred for the preparation of such compositions. Examples of compounds useful as the promoter include phenolic substances such as phenol, naphthol, alkyl phenols, thiophenol, sulfurized alkyl phenols, and condensation products of formaldehyde with a phenolic substance; alcohols such as methanol, 2-propanol, octanol, cellosolve, carbitol, ethylene glycol, stearyl alcohol and cyclohexanol; and amines such as aniline, phenylene diamine, phenothiazine, phenol beta-naphthylamine and dodecylamine.

Usually, the basic composition obtained according to the above-described method is treated with carbon dioxide until its total base number (TBN) is less than about 50, as determined by ASTM procedure D-2896. In many instances, it is advantageous to form the basic product by adding the Ca or Mg base portionwise and carbonating after the addition of each portion. Products with very high metal ratios (10 or above) can be obtained by this method. As used herein, the term "metal ratio" refers to the ratio of total equivalents of alkaline earth metal in the sulfonate complex to equivalents of sulfonic acid anion therein. For example, a normal sulfonate has a metal ratio of 1.0 and a calcium sulfonate complex containing twice as much calcium as the normal salt has a metal ratio of 2.0. The overbased metal detergent compositions usually have metal ratios of at least about 1.1, for example, from about 1.1 to about 30, with metal ratios of from about 2 to 20 being preferred.

It is frequently advantageous to react the basic sulfonate with anthranilic acid, by heating the two at about 140°-200° C. The amount of anthranilic acid used is generally less than about 1 part (by weight) per 10 parts of sulfonate, preferably 1 part per 40-200 parts of sulfonate. The presence of anthranilic acid improves the oxidation- and corrosion-inhibiting effectiveness of the sulfonate.

Basic alkali and alkaline earth metal sulfonates are known in the art and methods for their preparation are described in a number of patents, such as U.S. Pat. Nos. 3,027,325; 3,312,618; and 3,350,308. Any of the sulfonates described in these and numerous other patents are suitable for use in the present invention.

The metal detergent inhibitor (e.g., the basic Ca and Mg salts) are preferably separately prepared and then admixed in the controlled amounts as provided herein. It will be generally convenient to admix such separately prepared detergent inhibitors in the presence of the diluent or solvent used in their preparation.

Other antioxidants useful in this invention include oil soluble copper compounds. The copper may be blended into the oil as any suitable oil soluble copper compound. By oil soluble we mean the compound is oil soluble under normal blending conditions in the oil or additive package. The copper compound may be in the cuprous or cupric form. The copper may be in the form of the copper dihydrocarbyl thio- or dithio-phosphates wherein copper may be substituted for zinc in the compounds and reactions described above although one mole of cuprous or cupric oxide may be reacted with one or two moles of the dithiophosphoric acid, respectively. Alternatively the copper may be added as the copper salt of a synthetic or natural carboxylic acid. Examples include $C_8$ to $C_{18}$ fatty acids such as 2-ethyl hexanoic acid, stearic or palmitic, but unsaturated acids such as oleic or branched carboxylic acids such as naphthenic acids of molecular weight from 200 to 500 or synthetic carboxylic acids are preferred because of the improved handling and solubility properties of the resulting copper carboxylates. Also useful are oil soluble copper dithiocarbamates of the general formula $(RR'NCSS)_nCu$, where n is 1 or 2 and R and R' are the same or different hydrocarbyl radicals containing from 1 to 18 and preferably 2 to 12 carbon atoms and including radicals such as alkyl, alkenyl, aryl, aralkyl, alkaryl and cycloaliphatic radicals. Particularly preferred as R and R' groups are alkyl groups of 2 to 8 carbon atoms Thus, the radicals may, for example, be ethyl, n-propyl, i-propyl, n-butyl, i-butyl, sec-butyl, amyl, n-hexyl, i-hexyl, n-heptyl, n-octyl, decyl, dodecyl, octadecyl, 2-ethylhexyl, phenyl, butylphenyl, cyclohexyl, methylcyclopentyl, propenyl, butenyl, etc. In order to obtain oil solubility, the total number of carbon atoms (i.e., R and R') will generally be about 5 or greater. Copper sulphonates, including alkaryl sulfonates as described herein above, (i.e., salts of optionally sulfurized alkylphenols as described hereinabove) phenates, and acetylacetonates may also be used.

Exemplary of useful copper compounds are copper ($Cu^I$ and/or $Cu^{II}$) salts of alkenyl succinic acids or anhydrides. The salts themselves may be basic, neutral or acidic. They may be formed by reacting (a) any of the materials discussed above in the Ashless Dispersant section, which have at least one free carboxylic acid (or anhydride) group with (b) a reactive metal compound. Suitable acid (or anhydride) reactive metal compounds include those such as cupric or cuprous hydroxides, oxides, acetates, borates, and carbonates or basic copper carbonate.

Examples of the metal salts of this invention are Cu salts of polyisobutenyl succinic anhydride (hereinafter referred to as Cu-PIBSA), and Cu salts of polyisobutenyl succinic acid. Preferably, the selected metal employed is its divalent form, e.g., $Cu^{+2}$. The preferred substrates are polyalkenyl succinic acids in which the alkenyl group has a number average molecular weight ($\overline{M}_n$) greater than about 700. The alkenyl group desirably has a $\overline{M}_n$ from about 900 to 1400, and up to 2500, with a $\overline{M}_n$ of about 950 being most preferred. Especially preferred, of those listed above in the section on Dispersants, is polyisobutylene succinic acid (PIBSA). These materials may desirably be dissolved in a solvent, such as a mineral oil, and heated in the presence of a water solution (or slurry) of the metal bearing material. Heating may take place between 70° and about 200° C. Temperatures of 110° to 140° C. are entirely adequate. It may be necessary, depending upon the salt produced, not to allow the reaction to remain at a temperature above about 140° C. for an extended period of time, e.g., longer than 5 hours, or decomposition of the salt may occur.

The copper antioxidants (e.g., Cu-PIBSA, Cu-oleate, or mixtures thereof) will be generally employed in an amount of from about 50-500 ppm by weight of the metal, in the final lubricating or fuel composition.

The copper antioxidants used in this invention are inexpensive and are effective at low concentrations and therefore do not add substantially to the cost of the product. The results obtained are frequently better than those obtained with previously used antioxidants, which are expensive and used in higher concentrations. In the amounts employed, the copper compounds do not interfere with the performance of other components of the lubricating composition.

While any effective amount of the copper antioxidant can be incorporated into the lubricating oil composition, it is contemplated that such effective amounts be sufficient to provide said lube oil composition with an amount of the copper antioxidant of from about 5 to 500 (more preferably 10 to 200, still more preferably 10 to 180, and most preferably 20 to 130 (e.g., 90 to 120)) part per million of added copper based on the weight of the lubricating oil composition. Of course, the preferred amount may depend amongst other factors on the quality of the basestock lubricating oil.

Corrosion inhibitors, also known as anti-corrosive agents, reduce the degradation of the non-ferrous metallic parts contacted by the lubricating oil composition. Illustrative of corrosion inhibitors are phosphosulfurized hydrocarbons and the products obtained by reaction of a phosphosulfurized hydrocarbon with an alkaline earth metal oxide or hydroxide, preferably in the presence of an alkylated phenol or of an alkylphenol thioester, and also preferably in the presence of carbon dioxide. Phosphosulfurized hydrocarbons are prepared by reacting a suitable hydrocarbon such as a terpene, a heavy petroleum fraction of a $C_2$ to $C_6$ olefin polymer such as polyisobutylene, with from 5 to 30 weight percent of a sulfide of phosphorus for ½ to 15 hours, at a temperature in the range of 65° to 320° C. Neutralization of the phosphosulfurized hydrocarbon may be effected in the manner taught in U.S. Pat. No. 1,969,324.

Other oxidation inhibitors can also be employed in addition to Component B, to assist, where desired, in further reducing the tendency of the mineral oils to deteriorate in service and to thereby reduce the formation of products of oxidation such as sludge and varnish-like deposits on the metal surfaces and to reduce viscosity growth. Such other oxidation inhibitors include alkaline earth metal salts of alkylphenolthioesters having preferably $C_5$ to $C_{12}$ alkyl side chains (such as calcium nonylphenol sulfide, barium t-octylphenyl sulfide, etc.), diphenyl amine, alkyl diphenyl amines, dioctylphenylamine, phenyl alpha-naphthylamine (and its alkylated derivatives), phosphosulfurized hydrocarbons, other sulfurized hydrocarbons (such as sulfurized phenols, sulfurized alkyl catechols, and the like), phenols, hindered-phenols, bis-phenols, catechol, alkylated catechols, etc.

Friction modifiers serve to impart the proper friction characteristics to lubricating oil compositions such as automatic transmission fluids.

Representative examples of suitable friction modifiers are found in U.S. Pat. No. 3,933,659 which discloses fatty acid esters and amides; U.S. Pat. No. 4,176,074 which describes molybdenum complexes of polyisobutenyl succinic anhydride-amino alkanols; U.S. Pat. No. 4,105,571 which discloses glycerol esters of dimerized fatty acids; U.S. Pat. No. 3,779,928 which discloses alkane phosphonic acid salts; U.S. Pat. No. 3,778,375 which discloses reaction products of a phosphonate with an oleamide; U.S. Pat. No. 3,852,205 which discloses S-carboxy-alkylene hydrocarbyl succinimide, S-carboxy-alkylene hydrocarbyl succinamic acid and mixtures thereof; U.S. Pat. No. 3,879,306 which discloses N-(hydroxyalkyl) alkenyl-succinamic acids or succinimides; U.S. Pat. No. 3,932,290 which discloses reaction products of di-(lower alkyl) phosphites and epoxides; and U.S. Pat. No. 4,028,258 which discloses the alkylene oxide adduct of phosphosulfurized N-(hydroxyalkyl) alkenyl succinimides. The disclosures of the above references are herein incorporated by reference. The most preferred friction modifiers are glycerol mono and dioleates, and succinate esters, or metal salts thereof, of hydrocarbyl substituted succinic acids or anhydrides and thiobis alkanols such as described in U.S. Pat. No. 4,344,853.

Pour point depressants lower the temperature at which the fluid will flow or can be poured. Such depressants are well known. Typical of those additives which usefully optimize the low temperature fluidity of the fluid are $C_8$–$C_{18}$ dialkylfumarate vinyl acetate copolymers, polymethacrylates, and wax naphthalene.

Foam control can be provided by an antifoamant of the polysiloxane type, e.g. silicone oil and polydimethyl siloxane.

Organic, oil-soluble compounds useful as rust inhibitors in this invention comprise nonionic surfactants such as polyoxyalkylene polyols and esters thereof, and anionic surfactants such as salts of alkyl sulfonic acids. Such anti-rust compounds are known and can be made by conventional means. Nonionic surfactants, useful as anti-rust additives in the oleaginous compositions of this invention, usually owe their surfactant properties to a number of weak stabilizing groups such as ether linkages. Nonionic anti-rust agents containing ether linkages can be made by alkoxylating organic substrates containing active hydrogens with an excess of the lower alkylene oxides (such as ethylene and propylene oxides) until the desired number of alkoxy groups have been placed in the molecule.

The preferred rust inhibitors are polyoxyalkylene polyols and derivatives thereof. This class of materials are commercially available from various sources: Pluronic Polyols from Wyandotte Chemicals Corporation; Polyglycol 112-2, a liquid triol derived from ethylene oxide and propylene oxide available from Dow Chemical Co.; and Tergitol, dodecylphenyl or monophenyl polyethylene glycol ethers, and Ucon, polyalkylene glycols and derivatives, both available from Union Carbide Corp. These are but a few of the commercial products suitable as rust inhibitors in the improved composition of the present invention.

In addition to the polyols per se, the esters thereof obtained by reacting the polyols with various carboylic acids are also suitable. Acids useful in preparing these esters are lauric acid, stearic acid, succinic acid, and alkyl- or alkenyl-substituted succinic acids wherein the alkyl-or alkenyl group contains up to about twenty carbon atoms.

The preferred polyols are prepared as block polymers. Thus, a hydroxy-substituted compound, R—(OH)n (wherein n is 1 to 6, and R is the residue of a mono- or polyhydric alcohol, phenol, naphthol, etc.) is reacted with propylene oxide to form a hydrophobic base. This base is then reacted with ethylene oxide to provide a hydrophylic portion resulting in a molecule having both hydrophobic and hydrophylic portions. The relative sizes of these portions can be adjusted by regulating the ratio of reactants, time of reaction, etc., as is obvious to those skilled in the art. Thus it is within the skill of the art to prepare polyols whose molecules are characterized by hydrophobic and hydrophylic moieties which are present in a ratio rendering rust inhibitors suitable for use in any lubricant composition regardless of differences in the base oils and the presence of other additives.

If more oil-solubility is needed in a given lubricating composition, the hydrophobic portion can be increased and/or the hydrophylic portion decreased. If greater oil-in-water emulsion breaking ability is required, the hydrophylic and/or hydrophobic portions can be adjusted to accomplish this.

Compounds illustrative of $R—(OH)_n$ include alkylene polyols such as the alkylene glycols, alkylene triols, alkylene tetrols, etc., such as ethylene glycol, propylene glycol, glycerol, pentaerythritol, sorbitol, mannitol, and the like. Aromatic hydroxy compounds such as alkylated mono- and polyhydric phenols and naphthols can also be used, e.g., heptylphenol, dodecylphenol, etc.

Other suitable demulsifiers include the esters disclosed in U.S. Pat. Nos. 3,098,827 and 2,674,619.

The liquid polyols available from Wyandotte Chemical Co. under the name Pluronic Polyols and other similar polyols are particularly well suited as rust inhibitors. These Pluronic Polyols correspond to the formula:

$$HO—(CH_2CH_2O)_x(\underset{\underset{CH_3}{|}}{CH}CH_2O)_y(CH_2CH_2O)_zH \qquad \text{(VIII)}$$

wherein x, y, and z are integers greater than 1 such that the $—CH_2CH_2O$ groups comprise from about 10% to about 40% by weight of the total molecular weight of the glycol, the average molecule weight of said glycol being from about 1000 to about 5000. These products are prepared by first condensing propylene oxide with propylene glycol to produce the hydrophobic base $$HO(-\underset{\underset{CH_3}{|}}{CH}-CH_2-O)_y-H \quad (IX)$$

This condensation product is then treated with ethylene oxide to add hydrophylic portions to both ends of the molecule. For best results, the ethylene oxide units should comprise from about 10 to about 40% by weight of the molecule. Those products wherein the molecular weight of the polyol is from about 2500 to 4500 and the ethylene oxide units comprise from about 10% to about 15% by weight of the molecule are particularly suitable. The polyols having a molecular weight of about 4000 with about 10% attributable to ($CH_2CH_2O$) units are particularly good. Also useful are alkoxylated fatty amines, amides, alcohols and the like, including such alkoxylated fatty acid derivatives treated with $C_9$ to $C_{16}$ alkyl-substituted phenols (such as the mono- and di-heptyl, octyl, nonyl, decyl, undecyl, dodecyl and tridecyl phenols), as described in U.S. Pat. No. 3,849,501, which is also hereby incorporated by reference in its entirety.

These compositions of our invention may also contain other additives such as those previously described, and other metal containing additives, for example, those containing barium and sodium.

The lubricating composition of the present invention may also include copper lead bearing corrosion inhibitors. Typically such compounds are the thiadiazole polysulphides containing from 5 to 50 carbon atoms, their derivatives and polymers thereof. Preferred materials are the derivatives of 1,3,4-thiadiazoles such as those described in U.S. Pat. Nos. 2,719,125; 2,719,126; and 3,087,932; especially preferred is the compound 2,5-bis (t-octadithio)-1,3,4 thiadiazole commercially available as Amoco 150, or 2,5-bis(nonyldithio)-1,3,4-thiadiazole available as Amoco 158. Other similar materials also suitable are described in U.S. Pat. Nos. 3,821,236; 3,904,537; 4,097,387; 4,107,059; 4,136,043; 4,188,299; and 4,193,882. Derivatives of thiadiazole mercaptans may be used such as esters, condensation products with halogenated carboxylic acids, reaction products with aldehydes and amines, alcohols or mercaptans, amine salts, dithiocarbamates, reaction products with ashless dispersants (e.g., U.S. Pat. No. 4,140,643 and U.S. Pat. No. 4,136,043) and reaction products with sulfur halides and olefins.

Other suitable additives are the thio and polythio sulphenamides of thiadiazoles such as those described in U.K. Patent Specification 1,560,830. When these compounds are included in the lubricating composition, we prefer that they be present in an amount from 0.01 to 10, preferably 0.1 to 5.0 weight percent based on the weight of the composition.

Some of these numerous additives can provide a multiplicity of effects, e.g., a dispersant-oxidation inhibitor. This approach is well known and need not be further elaborated herein.

Compositions when containing these conventional additives are typically blended into the base oil in amounts effective to provide their normal attendant function. Representative effective amounts of such additives (as the respective active ingredients) in the fully formulated oil are illustrated as follows:

| Compositions | Wt. % A.I. (Preferred) | Wt. % A.I. (Broad) |
|---|---|---|
| Component A | 4–7 | 3–10 |
| Component B | 2.2–4 | 2–6 |
| Component C | 1.0–2 | 0.8–3 |
| Viscosity Modifiers | 0–4 | 0–12 |
| Detergents | 0.01–0.4 | 0.01–0.6 |
| Corrosion Inhibitors | 0.01–0.5 | 0–1.5 |
| Other Oxidation Inhibitors | 0–1.5 | 0–5 |
| Pour Point Depressants | 0.01–0.5 | .01–1.0 |
| Anti-Foaming Agents | 0.001–0.01 | .001–0.1 |
| Other Anti-Wear Agents | 0.001–1.5 | 0–5 |
| Friction Modifiers | 0.01–1.5 | 0–5 |
| Lubricating Base Oil | Balance | Balance |

When other additives are employed, it may be desirable, although not necessary, to prepare additive concentrates comprising concentrated solutions or dispersions of the novel detergent inhibitor/antiwear agent mixtures of this invention (in concentrate amounts hereinabove described), together with one or more of said other additives (said concentrate when constituting an additive mixture being referred to herein as an additive-package) whereby several additives can be added simultaneously to the base oil to form the lubricating oil composition. Dissolution of the additive concentrate into the lubricating oil may be facilitated by solvents and by mixing accompanied with mild heating, but this is not essential. The concentrate or additive-package will typically be formulated to contain the additives in proper amounts to provide the desired concentration in the final formulation when the additive-package is combined with a predetermined amount of bas lubricant Thus, the detergent inhibitor/antiwear agent mixtures of the present invention can be added to small amounts of base oil or other compatible solvents along with other desirable additives to form additive-packages containing active ingredients in collective amounts of typically from about 2.5 to about 90%, and preferably from about 15 to about 75%, and most preferably from about 25 to about 60% by weight additives in the appropriate proportions with the remainder being base oil.

The final formulations may employ typically about 10 wt. % of the additive-package with the remainder being base oil.

All of said weight percents expressed herein (unless otherwise indicated) are based on active ingredient (A.I.) content of the additive, and/or upon the total weight of any additive-package, or formulation which will be the sum of the A.I. weight of each additive plus the weight of total oil or diluent.

This invention will be further understood by reference to the following examples, wherein all parts are parts by weight, unless otherwise noted and which include preferred embodiments of the invention.

EXAMPLES

A series of fully formulated SAE 15W40 lubricating oils are prepared having the components identified in Table I.

TABLE I

| | TEST FORMULATIONS (VOL %) | | | |
|---|---|---|---|---|
| | Comparative A | Comparative B | Example 1 | Example 2 |
| PIBSA-PAM Dispersant(1) | 7.57 | 5.54 | 7.57 | 7.57 |
| Sulfurized Alkyl Phenol Antioxidant(2) | 2.83 | 1.8 | 2.83 | 2.83 |

TABLE I-continued

| | TEST FORMULATIONS (VOL %) | | | |
|---|---|---|---|---|
| | Comparative A | Comparative B | Example 1 | Example 2 |
| Zinc Dialkyl Dithiophosphate Antiwear Agent[3] | 1.75 | 1.45 | 1.35 | 1.35 |
| Overbased Mg Sulfonate Detergent Inhibitor[4] | 1.19 | 1.45 | 0.51 | 0.51 |
| Viscosity Index Improver[5] | 8.82 | — | 8.20 | 8.40 |
| Base Oil[6] | Balance | Balance | Balance | Balance |
| TBN[7] | 8.4 | 8.0 | 5.0 | 5.0 |
| SASH[8] | 0.85 | 0.84 | 0.44 | 0.5 |

NOTES:

[1]Mixture of 5.93 vol % of polyisobutenyl succinimide (1.58 wt % N, 950 $\overline{M}_n$ PIB, 1.0 SA:PIB mole ratio, 0.35 wt % B, 51.5 wt % ai); and 1.64 vol % of polyisobutenyl succinimide, 1.46 wt % N, $\overline{M}_n$ PIB, 1.2 SA:PIB mole ratio, 0.32 wt % B, 50.8 wt % ai). As used herein, SA:PIB mole ratio refers to the moles of succinic anhydride reacted per mole of polyisobutylene to form polyisobutenyl succinic anhydride used to form the described succinimides.

[2]Sulfurized Nonylphenol (70 wt % ai, 7 wt % S).

[3]Comparative Ex. A.: 1.45 vol % zinc dihydrocarbyl dithiophosphate (ZDDP) antiwear additive in which the alkyl groups contained 8 carbon atoms and was made by reacting $R_2S_5$ with iso-octyl alcohol to give a phosphorous level of about 7 wt %; 0.30 vol % ZDDP antiwear additive in which the alkyl groups were a mixture of such groups having between about 4 and 5 carbon atoms and made by reacting $P_2S_5$ with a mixture of about 65% isobutyl alcohol and 35% of of amyl alcohol, to give a phosphorous level of about 8 wt %. Comparative Ex. B, and Example 1: 1.45 vol. % in which the alkyl groups contained 8 carbon atoms and was made by reacting $R_2S_5$ with iso-octyl alcohol to give a phosphorous level of about 7 wt % ZDDP antiwear additive.

[4]Overbased Mg sulfonate (based on an alkyl benzene sulfonic acid), 400 TBN, 51.7 wt % ai; 9.2 wt % Mg.

[5]Compar. Ex A and Ex 1 = ethylene-propylene copolymer viscosity index improver concentrate (43 wt % ethylene; 2.8 thickening efficiency; 10.0 wt % ai); Ex 2 = dispersant viscosity index improver concentrate (nitrogen-containing ethylene-propylene copolymer 0.3 wt % N; 1.5 thickening efficiency; 23 wt % ai).

[6]Principally Solvent 150 Neutral base oil.

[7]Total base number; ASTM D2896.

[8]Total sulfated ash level (ASTM D874).

The formulations are subjected to a Cummins NTC-400 field test (loads=refrigerated trailers; 80,000 lbs. gross vehicle weight, approx. 80% load factor; continental United States service (ex-Alaska), with majority of hauling from Dallas to Pacific Northwest, wherein diesel fuels <0.3 wt % sulfur were employed.

Also included in the above tests are the following commercial SAE 15W40 lubricating oils. These formulations include ashless dispersant, overbased alkaline earth metal detergent inhibitors, and zinc dihydrocarbyl dithiophosphate antiwear agents.

| Comparative Test Oils | Wt % SASH | TBN (D2896) |
|---|---|---|
| Oil C | 1.0 | 10 |
| Oil D | 1.1 | 12 |
| Oil E | 0.72 | 6.9 |
| Oil F | 1.0 | 10 |
| Oil G | 1.0 | 8 |
| Oil H | 1.0 | 8 |
| Oil I | 1.0 | 8 |
| Oil J | 0.9 | 7 |
| Oil K | 1.95 | 14 |

The data thereby obtained are set forth in Table III.

TABLE III

| OIL TYPE | COMPARATIVE EXAMPLES A | B | C | D | E | F | G | H | I | J | K | COMMERCIAL OIL AVG | SIGMA (G) | EXAMPLE 1 |
|---|---|---|---|---|---|---|---|---|---|---|---|---|---|---|
| UNIT MILEGE | 196K | 207K | 175K | 195K | 211K | 189K* | 187K | 173K | 200K | 183K | 177K | 190K | 12.8 | 168K |
| AVG. SLUDGE | 9.84 | 9.78 | 9.76 | 9.83 | 9.75 | 9.81 | 9.76 | 9.75 | 9.74 | 9.73 | 9.78 | 9.78 | 0.04 | 9.76 |
| TGF, % | 67 | 40 | 40 | 70 | 56 | — | 63 | 64 | 84 | 59 | 83 | 63 | 15 | 35 |
| 2ND GF, % | 39 | 39 | 34 | 40 | 85 | — | 73 | 40 | 47 | 76 | 30 | 50 | 19.8 | 66 |
| 3RD GF, | 8 | 5 | 0 | 1 | 15 | — | 6 | 5 | 6 | 10 | 3 | 5.9 | 4.4 | 2 |
| 4G DEMERIT | 0.59 | 1.29 | 0.32 | 0.67 | 1.86 | — | 0.63 | 0.71 | 0.21 | 2.21 | 0.7 | 0.92 | 0.66 | 1.8 |
| CROWNLAND | | | | | | | | | | | | | | |
| HEAVY CARBON, % | 8 | 9 | 24 | 10 | 7 | 15 | 7 | 22 | 43 | 15 | 62 | 20.2 | 17.6 | 10 |
| POLISHED CARBON % | 17 | 35 | 59 | 35 | 29 | 45 | 39 | 33 | 49 | 32 | 35 | 37.1 | 11.0 | 31 |
| CLEAN, % | 1 | 0 | 0 | 0 | 1 | 0 | 3 | 8 | 0 | 0 | 5 | 1.6 | 2.6 | 12 |
| TOTAL LAND DEMERITS | 21.59 | 26.42 | 28.8 | 22.73 | 36.37 | — | 31.47 | 28.11 | 27.55 | 35.14 | 20.4 | 27.86 | 5.4 | 28.4 |
| UNDERCROWN DEMERITS | 5.13 | 5.44 | 1.88 | 3.51 | 10.00 | — | 3.19 | 4.19 | 3.69 | 4.88 | 2.0 | 4.39 | 2.31 | 7.8 |
| TTL. UNWEIGHTED DEM | 137 | 115 | 119 | 138 | 199 | — | 180 | 140 | 167 | 185 | 137 | 151.7 | 29.0 | 138 |
| TOTAL WEIGHTED DEM | 987 | 1073 | 872 | 889 | 2144 | — | 1574 | 1022 | 1069 | 1840 | 703 | 1217 | 471 | 1355 |
| OIL ECONOMY, MI./QT. | 524 | 473 | 609 | 1024 | 450 | 513 | 612 | 694 | 312 | 332 | 613 | 536 | 203 | 359 |
| CYLINDER LINER | | | | | | | | | | | | | | |
| MAX. WEAR, IN. | .0015 | .0018 | .0028 | .0018 | .0023 | .0025 | .0008 | .0022 | .0017 | .0015 | .0015 | .00185 | .0006 | .0017 |
| AVG. MAX. WEAR, IN. | .0012 | .0012 | .0022 | .0012 | .0021 | .0023 | .0007 | .0015 | .0013 | .0013 | .0013 | .0015 | .0005 | .0017 |
| WEAR RATE, IN./100 KMI | .0006 | .0006 | .0013 | .0006 | .0010 | .0012 | .0004 | .0009 | .0007 | .0007 | .0007 | .0008 | .0003 | .0010 |
| HONE RETAINED, % | 83 | 93 | 95 | 95 | 92 | 92 | 88 | 94 | 92 | 93 | 80 | 90.6 | 4.9 | 80 |
| BORE POLISH, % | 7 | 7 | 2 | 2 | 8 | 7 | 9 | 7 | 9 | 7 | 9 | 6.7 | 2.5 | 9 |
| RING GAPS, IN. | | | | | | | | | | | | | | |
| NO. 1 | .025 | .026 | .024 | .028 | .027 | .027 | .030 | .027 | .025 | .025 | .022 | .026 | .002 | .022 |
| NO. 2 | .031 | .030 | .028 | .030 | .028 | .031 | .031 | .028 | .030 | .030 | .024 | .029 | .002 | .026 |
| NO. 3 | .024 | .027 | .023 | .029 | .026 | .025 | .028 | .028 | .027 | .025 | .024 | .026 | .002 | .028 |
| NO. 4 | .024 | .020 | .019 | .020 | .019 | .025 | .025 | .020 | .019 | .021 | .014 | .021 | .003 | .014 |
| CON ROD BEARING, % C4 | | | | | | | | | | | | | | |
| ROD | 0 | 0 | 0 | 0 | 0 | 0 | 0 | 0 | 0 | 0 | 0 | 0 | — | 0 |
| CAP | 0 | 0 | 0 | 0 | 0 | 0 | 0 | 0 | 0 | 0 | 0 | 0 | — | 0 |

*PISTON DEPOSIT RATINGS UNAVAILABLE - SITE MAINTENANCE PERSONNEL CLEANED AND RE-USED PISTONS.

From the data in Table III, it can be seen that the oil of Example 1 provides superior crownland cleanliness without sacrificing any of the remaining performance properties.

EXAMPLE 3

The low ash lubricating oil of Example 1 was subjected to a series of additional engine tests, and the data thereby obtained are summarized in Table IV. As can be seen, the oil of Example 1 passes all of the requirements of the American Petroleum Institute's CE specification for commercial heavy duty diesel lubricating oils.

TABLE IV

| Engine Tests* | Example 3 Test Results | API "CE" Limit | Pass/Fail |
|---|---|---|---|
| L-38 Total Bearing Wt. Loss, mg. | 33.8 | 50 max | Pass |
| Caterpillar 1G/2 (480 hrs.) | | | |
| TGF | 54 | 80 max | Pass |
| WTD | 204 | 300 max | |
| Mack T-6 | | | |
| Oil Consumption, lb/Hp-hr | 0.00049 | 0.0014 max | Pass |
| Total Demerits | 649 | 650 max | |
| Max Proudness, in. | 0.009 | 0.020 max | |
| Ring Wt. Loss, mg. | 307 | 350 max | |
| Viscosity Increase, cSt | 4.2 | 14 max | |
| Estimated Mack Merits | 112 | 90 min | |
| Mack T-7 100–150 Hour Viscosity Increase Rate, cSt/hr | 0.0092 | 0.040 max | Pass |
| Cummins NTC-400 | | | |
| Oil Consumption | SEE FIG. 1 | | Pass |
| Crownland Carbon, % | 9.2 | 25 max | |
| Third Land Demerits | 12.1 | 40 max | |
| Roller Follower Pin Wear, in. | 0.0000 | 0.002 max | |

*Performance procedure described in Society of Automotive Engineers Specification J183.

The low ash oils of this invention are preferably employed in heavy duty diesel engines which employ normally liquid fuels having a sulfur content of less than 1 wt. %, more preferably less than 0.5 wt. %, still more preferably less than 0.3 wt. % (e.g., from about 0.1 to about 0.3 wt %), and most preferably less than 0.1 wt. % (e.g., from 100 to 500 ppm sulfur). Such normally liquid fuels include hydrocarbonaceous petroleum distillate fuels such as diesel fuels or fuel oils as defined by ASTM Specification D396. Compression ignited engines can also employ normally liquid fuel compositions comprising non-hydrocarbonaceous materials such as alcohols, ethers, organonitro compounds and the like (e.g., methanol, ethanol, diethyl ether, methyl ethyl ether, nitromethane) are also within the scope of this invention as are liquid fuels derived from vegetable or mineral sources such as corn, alfalfa, shale and coal. Normally liquid fuels which are mixtures of one or more hydrocarbonaceous fuels and one or more non-hydrocarbonaceous materials are also contemplated. Examples of such mixtures are combinations of diesel fuel and ether. Particularly preferred is No. 2 diesel fuel.

The lubricating oils of this invention are particularly useful in the crankcase of diesel engines having cylinders (generally from 1 to 8 cylinders or more per engine) wherein there is housed for vertical cyclic reciprocation therein a piston provided with a tight top land, that is, cylinders wherein the distance between the piston's top land and the cylinder wall liner is reduced to minimize the amount of particulates generated in the cylinder's firing chamber (wherein the fuel is combusted to generate power). Such tight top lands can also provide improved fuel economy and an increase in the effective compression ratio in the cylinder. The top land comprises the region of the generally cylindrical piston above the top piston ring groove, and the top land, therefore, is generally characterized by a circular cross-section (taken along the longitudinal axis of the piston). The outer periphery of the top land can comprise a substantially vertical surface which is designed to be substantially parallel to the vertical walls of the cylinder liner. (Such top lands are herein referred to as "cylindrical top lands".) Or, as is preferred, the top land can be tapered inwardly toward the center of the piston from the point at which the top land adjoins the top piston ring groove and the uppermost surface of the piston, i.e., the "crown". The distance between the top land and the cylinder wall liner, herein called the "top land clearance", will preferably range from about 0.010 to 0.030 inch for cylindrical top lands For tapered top lands, the lower top land clearance (that is, the top land clearance at the point at which the top land is adjoined to the top piston ring groove) is preferably from about 0.005 to 0.030 inch, and more preferably from about 0.010 to 0.020 inch, and the upper top land clearance, that is, the top land clearance at the piston crown, is preferably from about 0.010 to 0.045 inch, and more preferably from about 0.015 to 0.030 inch. While the top land clearance can be less than the dimensions given above (e.g., less than 0.005 inch), if such lesser distances do not result in undesired contact of the top land portion of the piston with the cylinder wall liner during operation of the engine, which is undesirable due to the resultant damage to the liner. Generally, the height of the top land (that is, the vertical distance, as measured along the cylinder wall liner, from the bottom of the top land to the top of the top land) is from about 0.1 to about 1.2 inch, which is generally from about 0.8 to 1.2 inch for 4-cycle diesel engines and from about 0.1 to 0.5 inch for 2-cycle diesel engines. The design of diesel engines and such pistons having such tight top lands is within the skill of the skilled artisan and need not be further described herein.

The principles, preferred embodiments, and modes of operation of the present invention have been described in the foregoing specification. The invention which is intended to be protected herein, however, is not to be construed as limited to the particular forms disclosed, since these are to be regarding as illustrative rather than restrictive. Variations and changes may be made by those skilled in the art without departing from the spirit of the invention.

What is claimed is:

1. A method for improving the performance of a heavy duty diesel lubricating oil adapted for use in a diesel engine in conjunction with a normally liquid fuel having a sulfur content of less than 1 weight percent, which comprises controlling the metal content of the oil to provide a total sulfated ash (SASH) level in said oil of less than about 0.6 weight percent and a weight ration of SASH:dispersant of from 0.01 to about 0.2:1, and providing in said oil (A) at least about 3 weight percent ashless dispersant, (B), at least about 2 weight percent sulfurized alkyl phenol oxidation inhibitor, and (c) an antiwear effective amount of at least one metal salt of a dihydrocarbyl dithiophosphoric acid wherein each of said groups in said acid has, on the average, at least 6 carbon atoms.

2. A method for preparing a heavy duty diesel lubricating oil adapted for meeting the American Petroleum Institute CE specifications, which comprises formulating a lubricating oil have a metal content such that the oil has a total sulfated ash (SASH) level of less than about 0.6 weight percent and a weight ration of SASH:-dispersant of from about 0.01:1 to about 0.2:1, said lubricating oil comprising a major amount of oil of lubricating viscosity and (A) at least about 3 weight percent ashless dispersant, (B) at least about 2 weight percent sulfurized alkyl phenol oxidation inhibitor, and (C) an antiwear effective amount of at least one metal salt of a dihydrocarbyl dithiophosphoric acid wherein each of said hydrocarbyl groups in said acid has, ion the average, at least 6 carbon atoms.

3. A method for improving the performance of a heavy duty diesel lubricating oil adapted for use in a diesel engine provided with at least one tight top land piston which comprises controlling the metal content of the oil to provide a total sulfated ash (SASH) level in said oil of less than about 0.6 wt % and a weight ratio of SASH:dispersant of from about 0.01:1 to 0.2:1, and formulating said oil to comprise a major amount of oil of lubricating viscosity and (A) at least about 3 wt % sulfurized alkyl dispersant, (B) at least about 2 wt % sulfurized alkyl phenol oxidation inhibitor, and (C) an antiwear effective amount of at least one metal salt of a dihydrocarbyl dithiophosphoric acid wherein each of said hydrocarbyl groups in said acid has, on the average, at least 6 carbon atoms.

4. The method according to claim 3 wherein said diesel engine is adapted for use in conjunction with a normally liquid fuel having a sulfur content of less than 1 wt %.

5. In a method for operating a diesel engine having a lubricating oil crankcase and at least one tight top land piston, the improvement which comprises providing in said crankcase a lubricating effective amount of a lubricating oil composition which comprises a major amount of an oil of lubricating viscosity and a minor amount of (A) at least about 3 wt % ashless dispersant, (B) at least about 2 wt % sulfurized alkyl phenol oxidation inhibitor, and (C) an antiwear effective amount of at least one metal salt of a dihydrocarbyl dithiophosphoric acid wherein each of said hydrocarbyl groups in said acid has, on the average, at least 6 carbon atoms, and wherein said lubricating oil composition is characterized by a total sulfated ash (SASH) level of from 0.01 to about 0.6 wt % and a weight ratio of SASH:dispersant of from 0.01:1 to 0.2:1.

6. The method according to claim 5 wherein said diesel engine is adapted for use in conjunction with a normally liquid fuel having a sulfur content of less than 1 wt %.

* * * * *